US010804664B2

(12) United States Patent
Sullivan et al.

(10) Patent No.: US 10,804,664 B2
(45) Date of Patent: Oct. 13, 2020

(54) CRIMP TOOL HAVING ADJUSTABLE CAM

(71) Applicant: SULLSTAR TECHNOLOGIES, INC., Simi Valley, CA (US)

(72) Inventors: Robert W. Sullivan, Simi Valley, CA (US); Kuan Yu Wang, New Taipei (TW); Wen-Lung Hung, New Taipei (TW)

( * ) Notice: Subject to any disclaimer, the term of this patent is extended or adjusted under 35 U.S.C. 154(b) by 0 days.

(21) Appl. No.: 15/832,707

(22) Filed: Dec. 5, 2017

(65) Prior Publication Data

US 2018/0205194 A1 Jul. 19, 2018

(30) Foreign Application Priority Data

Jan. 13, 2017 (TW) ..... 106101313 A

(51) Int. Cl.
*H01R 43/042* (2006.01)
*H01R 43/048* (2006.01)

(52) U.S. Cl.
CPC ..... *H01R 43/042* (2013.01); *H01R 43/0488* (2013.01)

(58) Field of Classification Search
CPC ..... H01R 43/042; H01R 43/0488
See application file for complete search history.

(56) References Cited

U.S. PATENT DOCUMENTS 2,746,327 A 5/1956 Runde
4,157,594 A 6/1979 Raabe
4,158,312 A 6/1979 O'Loughlin
5,105,648 A * 4/1992 Steiner ..... B25B 27/146 29/751
5,842,371 A * 12/1998 Liaw ..... H01R 43/042 72/409.12
5,870,925 A * 2/1999 Morris ..... B25B 27/146 29/751
5,913,933 A 6/1999 Beetz
(Continued)

FOREIGN PATENT DOCUMENTS

CN 2329596 Y 7/1999
CN 2549628 Y 5/2003
(Continued)

OTHER PUBLICATIONS

Canadian Intellectual Property Office (CIPO); First Office Action (1OA) and Search Report (Srch_Rpt) for corresponding patent application No. 2,988,344, entitled Crimp tool having adjustable cam by Robert W. Sullivan, dated Oct. 12, 2018 from Canadian Intellectual Property Office, 3 pgs.
(Continued)

*Primary Examiner* — Minh N Trinh
(74) *Attorney, Agent, or Firm* — Charles C. H. Wu; Wu & Reddy, A Prof. Corp.

(57) ABSTRACT

The invention is related to a crimp tool having an adjustable cam for accomplishing precision machining of a connector with a cable. The adjustable cam is provided at one of the handles of the crimp tool and is configured to prevent a moving handle of the crimp tool from moving beyond the adjustable cam so as to allow a user to adjust the pivot range of the moving handle, which controls the extent of the movement of a machining block in a machining portion of the crimp tool.

21 Claims, 20 Drawing Sheets

(56) References Cited

U.S. PATENT DOCUMENTS

| | | | | |
|---|---|---|---|---|
| 7,210,327 | B1 * | 5/2007 | Tarpill | B25B 27/10 29/751 |
| 9,184,548 | B2 * | 11/2015 | Hutchfield | B25B 27/146 |
| 9,923,326 | B2 | 3/2018 | Sullivan | |
| 10,490,963 | B2 | 11/2019 | Sullivan | |
| 2004/0163505 | A1 | 8/2004 | Durham | |
| 2011/0030447 | A1 | 2/2011 | Backenstoes | |
| 2015/0165597 | A1 | 6/2015 | Chern | |
| 2015/0273664 | A1 * | 10/2015 | Skodje | B25B 7/14 81/319 |
| 2017/0170618 | A1 * | 6/2017 | Ho | H01R 43/042 |
| 2018/0205194 | A1 * | 7/2018 | Sullivan | H01R 43/042 |

FOREIGN PATENT DOCUMENTS

| | | | |
|---|---|---|---|
| CN | 202957536 | U | 5/2013 |
| CN | 204843894 | U | 12/2015 |
| CN | 106571575 | A | 4/2017 |
| CN | 106571576 | A | 4/2017 |
| EP | 1987922 | A2 | 11/2008 |
| EP | 17176621.5-1801 | A1 | 11/2017 |
| GB | 2010729 | B1 | 7/1979 |
| JP | 51-108299 | A | 8/1976 |
| JP | 54-96898 | | 7/1979 |
| JP | 60-62788 | U | 5/1985 |
| JP | 2563233 | | 11/1997 |
| JP | 2000117656 | A | 4/2000 |
| JP | 204843894 | U | 12/2015 |
| TW | 200900206 | A | 1/2009 |
| TW | M445482 | | 1/2013 |
| TW | M449066 | | 3/2013 |
| TW | M489056 | | 11/2014 |
| WO | 2010/136346 | A1 | 12/2010 |

OTHER PUBLICATIONS

European Patent Office (EPO); extended European Search Report (eESR) for corresponding patent application No. 17176621.5, entitled Crimp tool having adjustable cam by Robert W. Sullivan, dated Nov. 14, 2017 from European Property Office, 8 pgs.

Japan Patent Office (JPO); First Office Action (1OA) English translation for corresponding patent application No. 2017-129949, entitled Crimp tool having adjustable cam by Robert W. Sullivan, dated Dec. 12, 2018 from Japan Patent Office, 5 pgs.

Korean Intellectual Property Office (KIPO); First Office Action (1OA) English translation for corresponding patent application No. 10-2017-0113480, entitled Crimp tool having adjustable cam by Robert W. Sullivan, dated Feb. 22, 2019 from Korean Intellectual Property Office, 5 pgs.

Taiwan Intellectual Property Office (TIPO); First Office Action (1OA) and Search Report (Srch_Rpt) English translation for corresponding patent application No. 106101313, entitled Crimp tool having adjustable cam by Robert W. Sullivan, dated May 22, 2017 from Taiwan Intellectual Property Office, 4 pgs.

Platinum Tools; EZ-Viking Crimp Tool Catalog published in Jan. 2013 from Platinum Tools in Camarillo, Califomia, United States of America, 2 pgs.

Canadian Intellectual Property Office (CIPO); First Office Action (2OA) and Search Report (Srch_Rpt) for corresponding patent application No. 2,988,344, entitled Crimp tool having adjustable cam by Robert W. Sullivan, dated Jun. 18, 2019 from Canadian Intellectual Property Office, 3 pgs.

China National Intellectual Property Administration (CNIPA); First Office Action (1OA) and Search Report (Srch_Rpt) for corresponding patent application No. 201710294103.7, entitled Crimp Tool Having Adjustable Cam by Robert W. Sullivan, dated Sep. 2, 2019 from China National Intellectual Property Administration, 12 pgs.

* cited by examiner

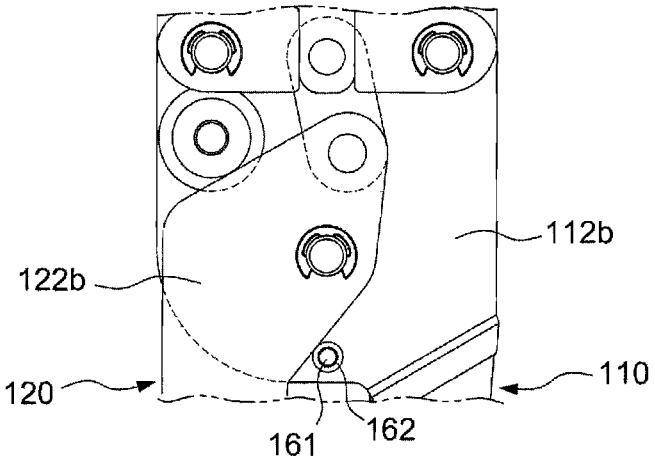
FIG. 4E1
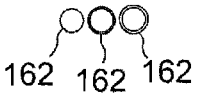
FIG. 4E2

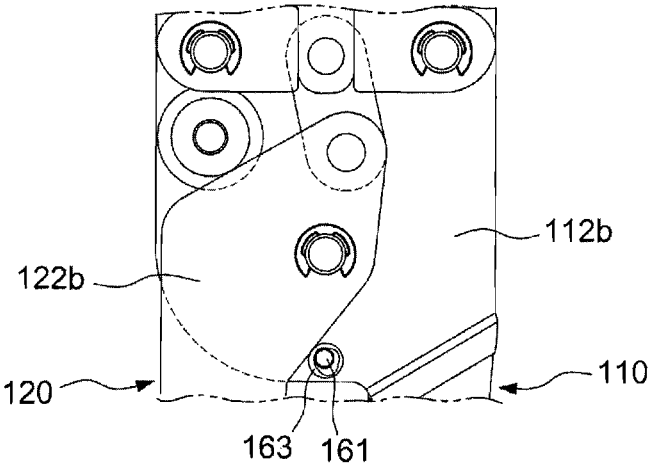
FIG. 4F1
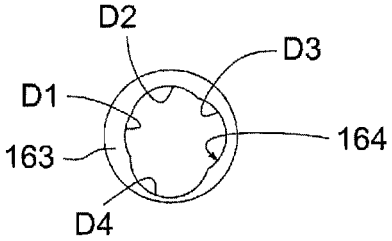
FIG. 4F2

CRIMP TOOL HAVING ADJUSTABLE CAM

CROSS-REFERENCE TO RELATED APPLICATIONS

The present invention claims the benefit of priority of Taiwan application No. 106101313 of Jan. 13, 2017, entitled "Crimp Tool Having Adjustable Cam," the content of which is incorporated herein by reference.

BACKGROUND

Field of the Invention

The present invention relates to a hand tool, in particular a crimp tool having an adjustable cam for precisely crimping connectors.

Description of Related Art

Pliers and crimp tools are frequently used for machining articles, such as bending, shearing, striping and crimping insulated wiring and telecommunication connectors thereof. These connectors include the RJ-45 connector, a connector standardized as the 8P8C modular connector, the RJ-11 connector, a connector for telephone connections, etc. A crimp tool usually includes two handles to be grasped by a user during operation. Generally speaking, when the crimp tool is in a contracted position, the contact driver is at its zenith position, pushing and seating wires in a cable into the corresponding connectors. At this zenith position the exact dimensions set by worldwide standards, for example FCC 68.5 Subpart F Specification, suggests a finished crimped height of 6.02+/−0.13 mm (0.237 inch+/−0.005). As many crimp tools are manufactured of various moving parts with linkages and pins, which create manufacturing tolerances, it is difficult for these crimp tools to meet a precise specification, resulting in improper crimp heights. On other occasions, in order to meet the precise specification, users may damage the crimp tool by applying an excessive amount of force to the handles thereof. Thus, there is a need for a crimp tool with a mechanism to control and adjust the tool to produce sufficiently precise crimped heights.

BRIEF SUMMARY OF THE INVENTION

In one embodiment of the invention, a crimp tool is provided. The crimp tool comprises: a first handle comprising an end portion comprising a first plate and a second plate spaced apart from the first plate and a second handle in which an end portion of the second handle is pivotally connected with the end portion of the first handle and is disposed between the first plate and the second plate, wherein the second handle pivots along a rotational path between a first position where the second handle is away from the first handle and a second position where the second handle is adjacent to the first handle; and means for defining the second position. The means for defining the second position is a pin disposed between the first plate and the second plate in an orientation that is generally perpendicular to the first plate and the second plate for preventing the second handle from moving further toward the first handle. The pin is interchangeable with another pin with a different diameter and when the second handle is moved to the second position, the end of the second handle does not contact a machining portion of the crimp tool.

BRIEF DESCRIPTION OF THE DRAWINGS

FIG. 4E1 is a regionally enlarged view of a crimp tool of a still further embodiment;

FIG. 4E2 is a schematic view showing sleeves of different thickness for use in the embodiment of FIG. 4E1.

FIG. 4F1 is a regionally enlarged view of a crimp tool of a still further embodiment;

FIG. 4F2 is an enlarged view of the sleeve used in the embodiment of FIG. 4F1;

DETAILED DESCRIPTION OF THE EXEMPLARY EMBODIMENTS

Figure 1A:
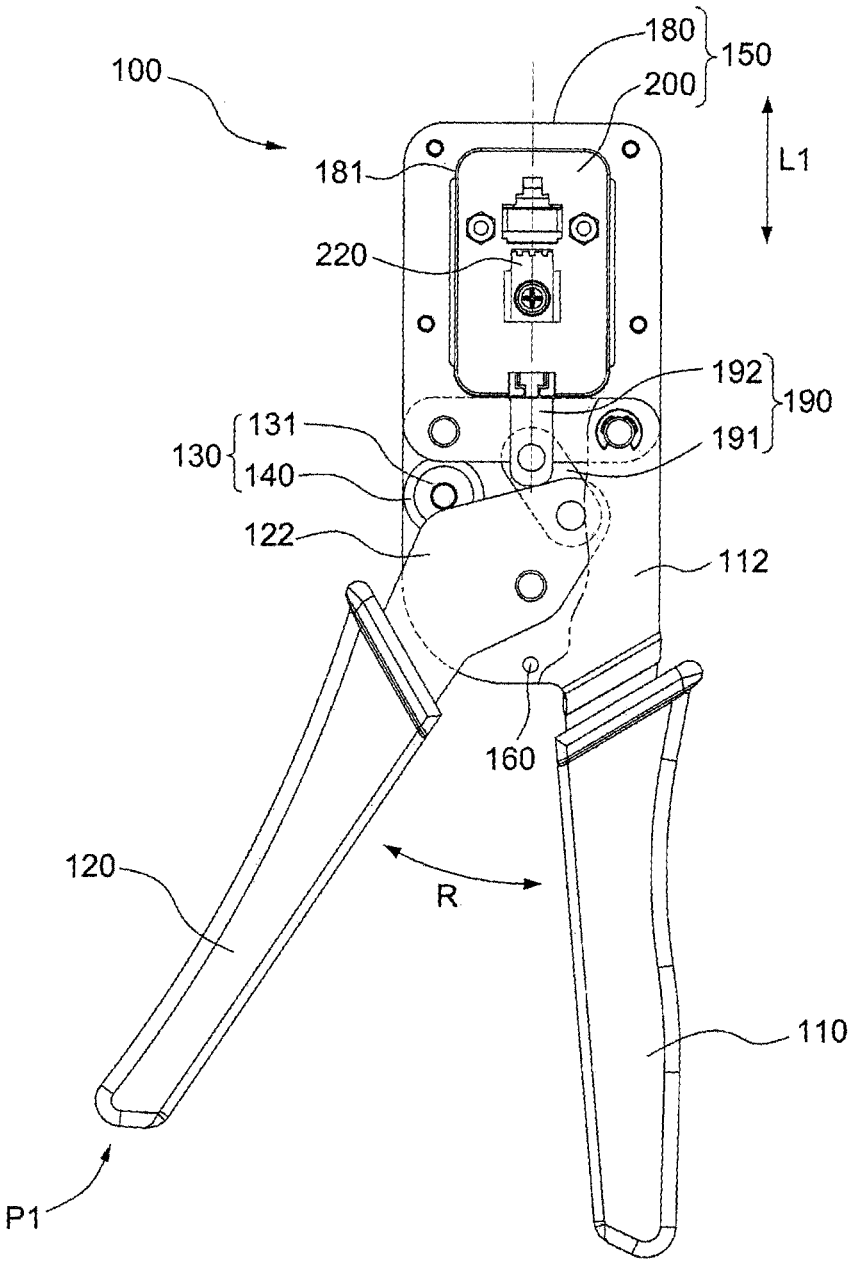
FIG. 1A is a schematic view showing a crimp tool of one embodiment of the present invention in a resting state.

The characteristics, subject matter, advantages, and effects of the present invention are detailed hereinafter by reference to embodiments of the present invention and the accompanying drawings. It is understood that the drawings referred to in the following description are intended only for purposes of illustration and do not necessarily show the actual proportion and precise arrangement of the embodiments. Therefore, the proportion and arrangement shown in the drawings should not be construed as limiting or restricting the scope of the present invention.

Figure 1B:
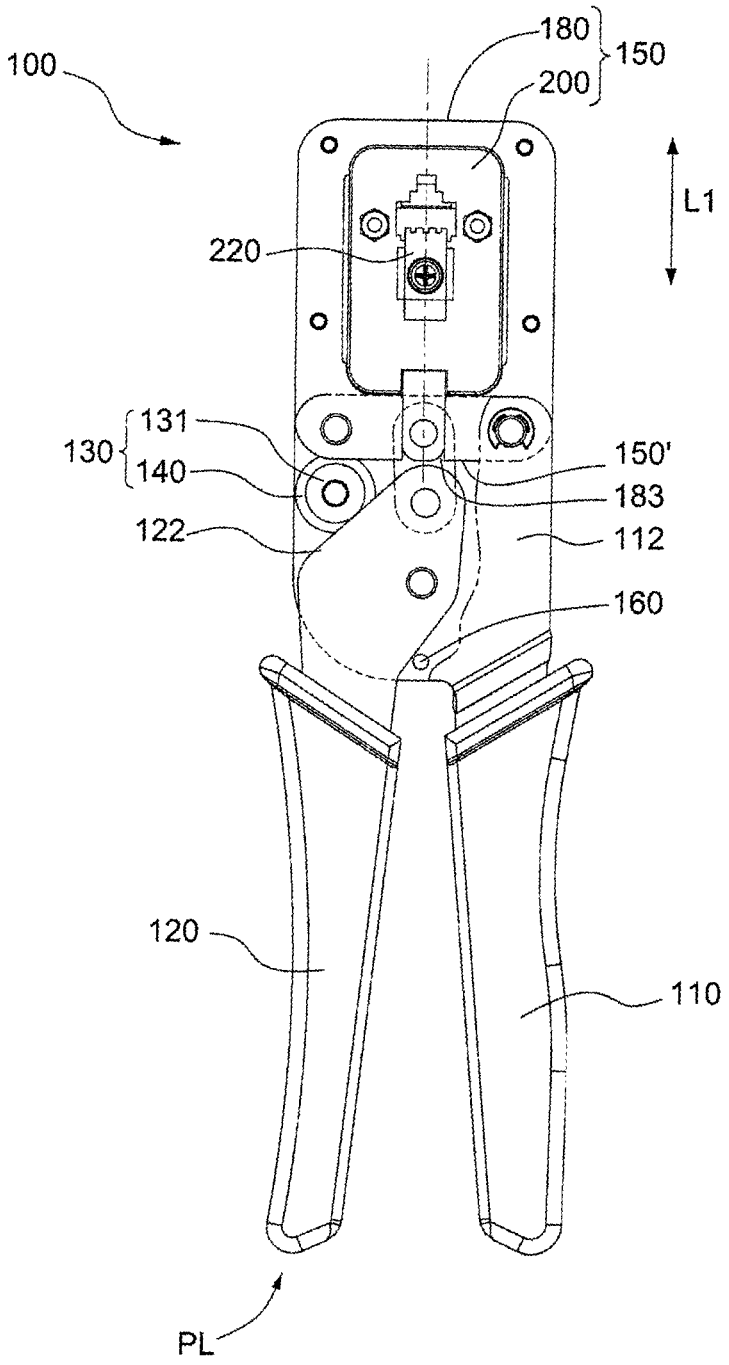
FIG. 1B is a schematic view showing the crimp tool of the embodiment in a state for storage.
Figure 1C:
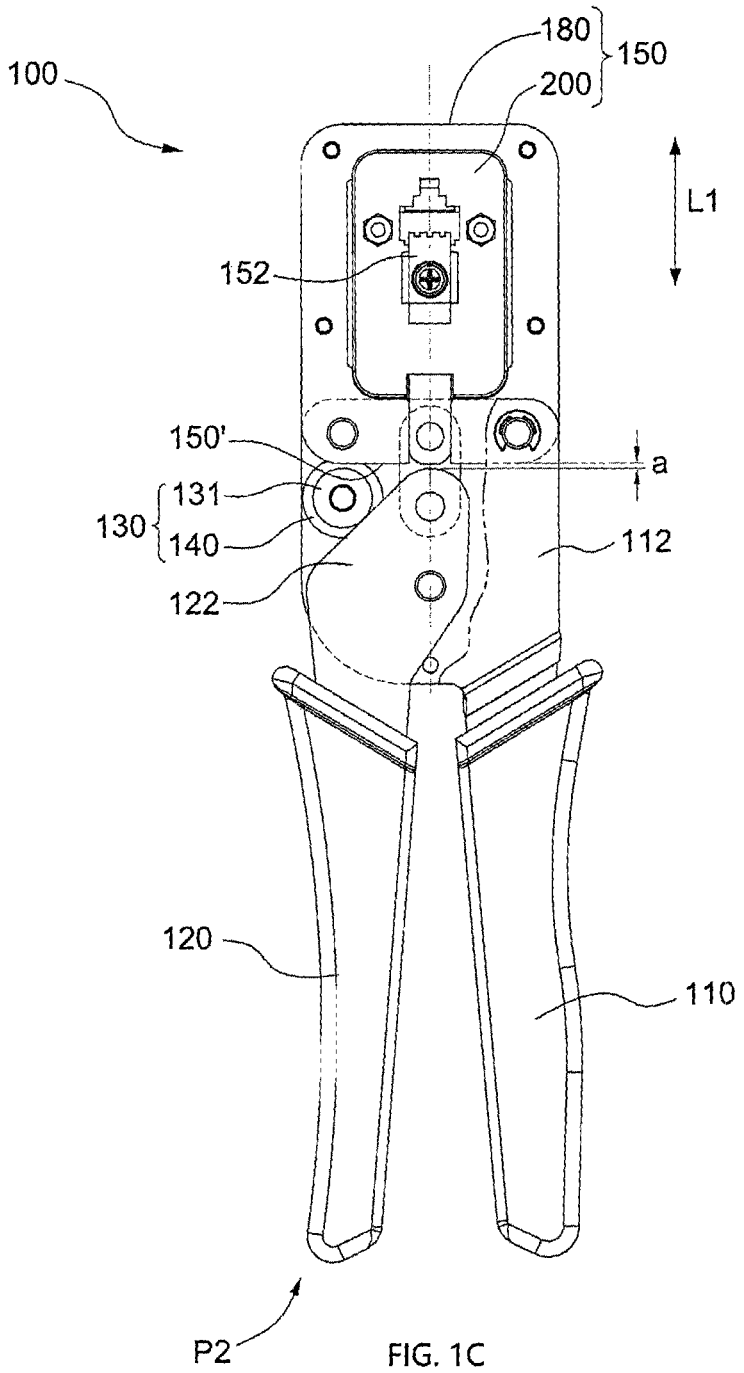
FIG. 1C is a schematic view showing the crimp tool of the embodiment in a working state.

Please refer to FIGS. 1A-1C. FIG. 1A is a schematic view showing a crimp tool of 100 one embodiment of the present invention in a resting state wherein the handles 110, 120 thereof are in an expanded position. FIG. 1C is a schematic view showing the crimp tool 100 of the embodiment in a working state wherein the handles 110, 120 of the crimp tool 100 of the embodiment are in a fully contracted position. FIG. 1B is a schematic view showing the crimp tool 100 of the embodiment in a state for storage wherein the handles 110, 120 of the crimp tool 100 of the embodiment are closed to each other but not yet fully contracted. The handle 120 is latched with a latch 130 so that it is ready for storage.

As shown in FIGS. 1A-2C, the crimp tool 100 comprises: a first handle 110, a second handle 120, a locking mechanism 130, a driving mechanism 190, and a machining portion 150. The machining portion 150 is connected with the first handle 110 and includes a frame 180 having an opening 181 for receiving a cassette 200. The driving mechanism 190 includes a link 191 pivotally connected with the end 122 of the second handle 120 with one end, and a driving element 192 pivotally connected with the other end of the link 191. The driving mechanism 190 is actuated by the second handle 120. The first handle 110 comprises a first plate 112*a* and a second plate 112*b* spaced apart from the first plate 112*a*. The end portion 122 of the second handle 120 is pivotally connected with the end portion 112 of the first handle 110 and is disposed between the first plate 112*a* and the second plate 112*b*. In operation, the second handle 120 pivots along a rotational path (R) between a first position (P1) where the second handle 120 is away from the first handle 110 (see FIG. 1A) and a second position (P2) where the second handle 120 is adjacent to the first handle 110 (see FIG. 1C). When the second handle 120 is in the second position (P2), the crimp tool 100 is in a working state for crimping a connector and a cable.

When a user grasps the handles 110, 120, the second handle 120 through the link 191 urges the driving element 192 to move upward, and the cassette 200 is actuated to machine the connector and the cable, such as shearing or crimping the connector and the cable. The crimp tool 100 is then switched from the resting state to the working state. When the user releases the handles 110, 120, a spring (S) provided at the pivot of the two handles 110, 120 (see FIGS. 2A and 2B) biases the second handle 120 so that the handles 110, 120 are urged into the expanded position. The crimp tool 100 is then switched from the working state to the resting state. During the above operation, the direction of motion (i.e., upward or downward direction) of the driving element 192 defines a first axis/vertical direction (L1). The means for defining the second position, such as an adjustable cam 160, is provided at the end portion 112 of the first handle 110 and is at the side of the proximate periphery of the end portion 122 of the second handle 120 such that when the second handle 120 is driven to move toward the first handle 110 along the rotational path (R), it will be stopped by the adjustable cam 160 at the second position (P2).

Figure 2A:
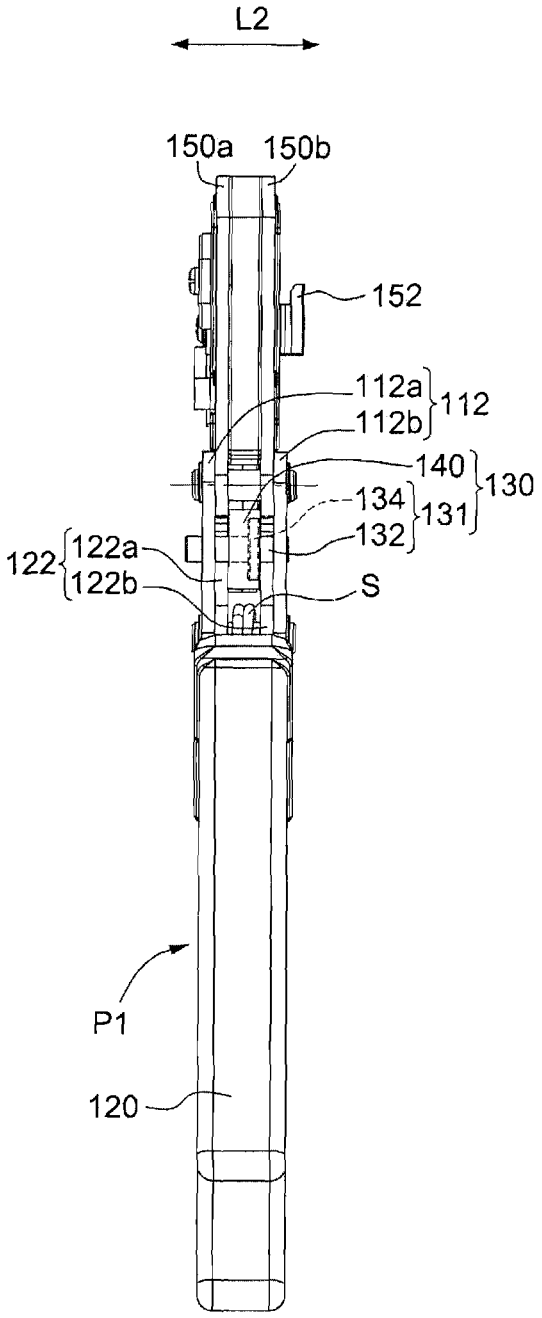
FIG. 2A is a schematic view showing a side of the crimp tool of FIG. 1A.
Figure 2B:
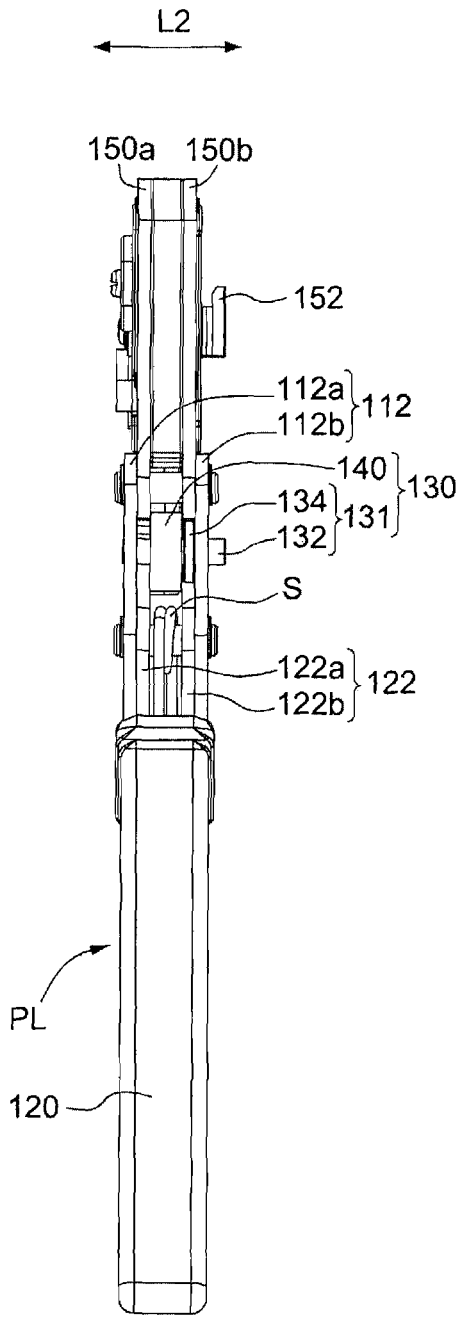
FIG. 2B is a schematic view showing a side of the crimp tool of FIG. 1B.
Figure 2C:
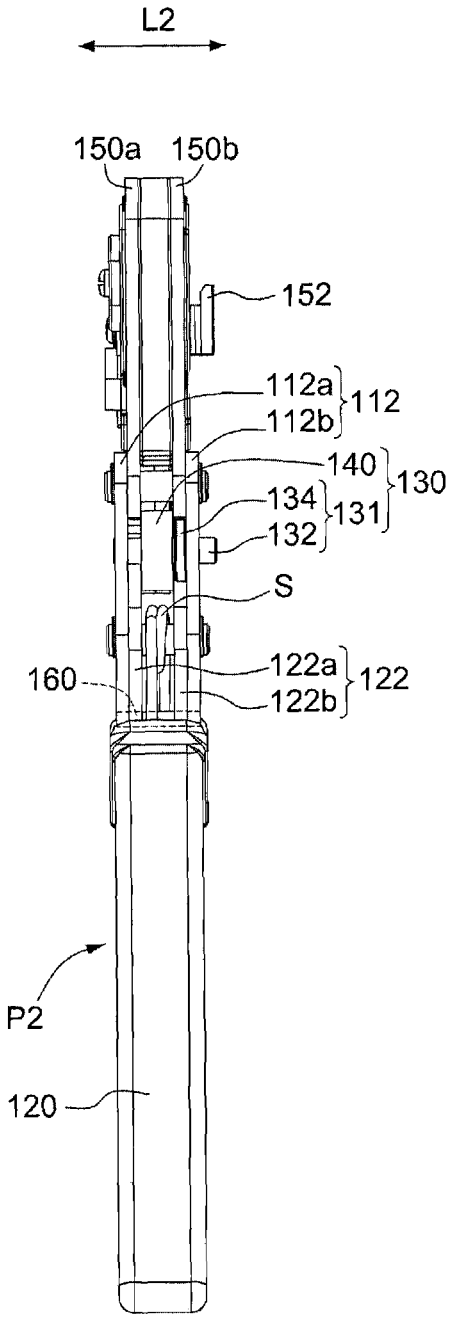
FIG. 2C is a schematic view showing a side of the crimp tool of FIG. 1C.

As shown in FIG. 2A, FIG. 2B and FIG. 2C, the end portion 112 of the first handle 110 comprises a first plate 112*a* and a second plate 112*b* opposite the first plate 112*a*. The end portion 122 of the second handle 120 comprises a third plate 122*a* and a fourth plate 122*b* opposite the third plate 122*a*, wherein the third plate 122*a* and the fourth plate 122*b* of the end portion 122 of the second handle 120 are sandwiched between and pivotally connected with the first plate 112*a* and the second plate 112*b* of the end portion 112 of the first handle 110. The machining portion 150 comprises a fifth plate 150*a* and a sixth plate 150*b* opposite the fifth plate 150*a*. The fifth plate 150*a* and the sixth plate 150*b* of the machining portion 150 are sandwiched between and fixed to the first plate 112*a* and the second plate 112*b* of the end portion 112 of the first handle 110. As shown in FIG. 2A-2C, the fifth plate 150*a* and the sixth plate 150*b* of the machining portion 150 are generally aligned with the third plate 122*a* and the fourth plate 122*b* of the end portion 122 of the second handle 120, respectively, in a direction (L2) transverse to the vertical direction (L1). As shown in FIG. 1C, the upper peripheral surfaces of the third plate 122*a* and the fourth plate 122*b* are spaced apart from the lower peripheral surfaces of the fifth plate 150*a* and the sixth plate 150*b* of the machining portion 150 with a gap (a) so that when the second handle 120 is pressed to move along the rotational path (R) toward the first handle 110 to the second position (P2), the end portion 122 of the second handle 120 does not contact the machining portion 150. The second handle 120 is stopped by the adjustable cam 160, which defines the second position (P2), or is constrained from moving further toward the first handle 110 by the locking mechanism 130 at a lock position (PL) before reaching the second position (P2).

Figure 3A:
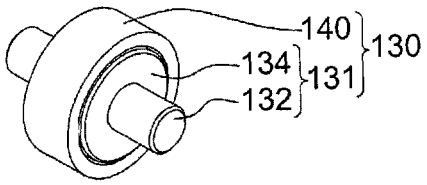
FIG. 3A is a schematic view showing the lock mechanism of the crimp tool of the embodiment.
Figure 3B:
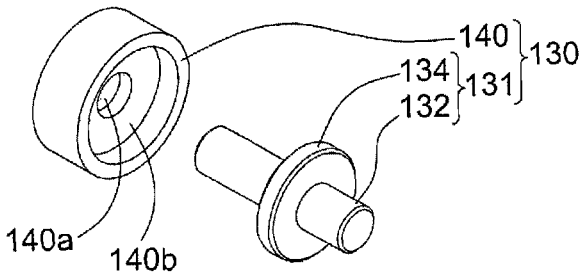
FIG. 3B is a schematic view showing the lock mechanism of the crimp tool of the embodiment wherein the latch is separated from the retainer.

FIG. 3A shows a perspective view of the lock mechanism 130 in one embodiment of the present invention. FIG. 3B shows an exploded view of the lock mechanism 130. As shown in FIGS. 3A and 3B, the lock mechanism 130 comprises: a latch 131 and a retainer 140. The latch 131 comprises: a disc 134 and a shaft 182 passing through the disc 134 and the area around the middle of the shaft 182 is fixed with the center of the disc 134. The shaft 182 is coaxial with the disc 134. Preferably, the shaft 182 is integrally formed with the disc 134. The retainer 140 is a sleeve having a through hole 140*a* and a recess 140*b* formed therein. The latch 131 is movably inserted into the recess 140*b*, and the recess 140*b* communicates with the through hole 140*a*. The sleeve is made of elastic material, preferably polyurethane. The diameter of the shaft 182 is smaller than that of the disc 134.

As shown in FIGS. 2A and 2B, the latch 131 is pivotally provided at the end portion 112 of the first handle 110 along the transverse direction (L2). Specifically, the shaft 182 of the latch 131 is pivotally supported at the first plate 112*a* and the second plate 112*b* of the end portion 112 of the first handle 110 with its two ends, respectively. The latch 131 is axially moveable along the transverse direction (L2) and accordingly is switchable between a third position (as shown in FIG. 2A) and a fourth position (as shown in FIG. 2B) so as to detain the second handle 120 in a first position (P1) or a lock position (PL). The lock position (PL) is between the first position (P1) and the second position (P2) and close to the second position (P2). When the latch 131 is at the third position as shown in FIG. 2A, the disc 134 is within the recess 140*b* and one end of the shaft 182 protrudes from a side surface of the first plate 112*a* of the first handle 110. When the latch 131 is at the fourth position as shown in FIG. 2B, the disc 134 at least partially protrudes from the recess 140*b* along the transverse direction (L2) and the other end of the shaft 182 protrudes from a side surface of the second plate 112*b* of the first handle 110.

When the latch 131 is at the third position, the second handle 120 is pivotable along the rotational path (R) between the first position (P1) and the second position (P2). In this situation, as shown in FIGS. 1A and 2A, if there is no external force applied to the second handle 120, the spring (S) biases the second handle 120 so that it moves away from the first handle 110 and the shaft 182 of the latch 131 restrains the second handle 120 at the first position (P1). As illustrated in FIGS. 1B and 2B, when the second handle 120 is pressed so that it moves toward the first handle 110 to the lock position (PL), the latch 131 is moved from the third position along the transverse direction (L2) to the fourth position and the disc 134 of the latch 131 restrains the second handle 120 at the lock position (PL). In this situation, the second handle 120 is fixed at the lock position (PL) and the crimp tool 100 occupies a smaller space, which is convenient for storage. In view of the above, by switching the latch 131 between the third position and the fourth position thereof, a user can restrain the second handle 120 at the first position (P1) or at the lock position (PL).

The retainer 140 of this embodiment is disposed to not be located in the rotational path (R) of the second handle 120 between the first position (P1) and the second position (P2). In one embodiment of the invention, the retainer 140 is a sleeve made of elastic material, preferably polyurethane. At least a part of the sleeve is sandwiched between the third plate 122*a* and the fourth plate 122*b* of the end portion 122 of the second handle 120. The length of the sleeve along the transverse direction (L2) is approximately the same as the distance between the third plate 122*a* and the fourth plate 122*b* of the end portion 122 of the second handle 120. In another embodiment of the present invention, at least a part of the sleeve is sandwiched between the fifth plate 150*a* and the sixth plate 150*b* of the machining portion 150. In that case, the length of the sleeve along the transverse direction (L2) is approximately the same as the distance between the fifth plate 150*a* and the sixth plate 150*b* of the machining portion 150. In an alternative embodiment, one part of the sleeve is sandwiched between the third plate 122*a* and the fourth plate 122*b* of the end portion 122 of the second handle 120 and the other part of the sleeve is sandwiched between the fifth plate 150*a* and the sixth plate 150*b* of the machining portion 150.

In one embodiment, the retainer 140 is a sleeve having a through hole 140*a* and a recess 140*b* formed therein. The latch 131 is movably inserted into the recess 140*b*, which communicates with the through hole 140*a*. The shaft 182 passes through the through hole 140*a* of the sleeve 140 with one end thereof. Two ends of the shaft 182 are pivotally supported at the end portion 112 of the first handle 110. When the latch 131 is disposed at the third position, the latch 131 is received within the recess 140*b* and the exposed side surface of the disc 134 of the latch 131 is generally flush with a side surface of the sleeve 140. When the latch 131 is pressed to move along the transverse direction (L2) from the third position to the fourth position, the disc 134 is moved from the recess 140*b* to at least partially protrude therefrom.

As such, when the latch 134 is received in the recess 140*b* (i.e., in the third position), the shaft 182 is in the rotational path (R) of the second handle 120. Where the handles 110, 120 of the crimp tool 100 are not grasped, the second handle 120 is biased by the spring (S) to move away from the first handle 110 and the configurations of at least one of the third plate 122*a* or the fourth plate 122*b* of the end portion 122 of the second handle 120 cause the at least one of the upper peripheral surfaces of the third plate 122*a* or the fourth plate 122*b* to abut against the shaft 182 to restrain the second handle 120 at the first position (P1). In the embodiment shown in the drawings, both the upper peripheral surfaces of the third plate 122*a* and the fourth plate 122*b* abut against the side of the shaft 182.

As shown in FIG. 2A, when the upper peripheral surfaces of the third plate 122*a* and the fourth plate 122*b* abut against the shaft 182 (i.e., the second handle is at the first position (P1)), since the diameter of the disc 134 is larger than that of the shaft 182 abutted by the fourth plate 122*b*, the upper portion of the fourth plate 122*b* is located beside and overlaps the disc 134 in the transverse direction (L2) so as to prevent the latch 134 from moving from the third position toward the fourth position along the transverse direction (L2). In this situation, the second handle 120 is free to pivot between the first position (P1) and the second position (P2) along the rotational path (R) and the crimp tool 100 is not locked. In an alternative embodiment, it can be the upper peripheral surfaces of only one of the third plate 122*a* and the fourth plate 122*b* that abut against the shaft 182 and it is the third plate 122*a* that prevents the latch 134 from moving outward.

When the second handle 120 is pressed so that it gradually moves from the first position (P1) toward the lock position (PL), the overlapping area between the upper portion of the fourth plate 122*b* and the disc 134 of the latch 131 gradually decreases. When the second handle 120 reaches the lock position (PL), as shown in FIGS. 1B and 2B, the upper portion of the fourth plate 122*b* does not overlap the disc 134 of the latch 131 in the transverse direction (L2) and a user can press against the shaft 182 of the latch 131 so that the latch 131 moves from the third position (as shown in FIG. 2A) to the fourth position (as shown in FIG. 2B). As such, the disc 134 is moved along the transverse direction (L2) from the recess 140*b* to at least partially protrude from the recess 140*b* and in the rotational path (R) of the second handle 120. When the user releases the pressure of his/her grasp on the second handle 120, the peripheral surface of the fourth plate 122*b* is urged by the spring (S) to abut against the peripheral surface of the disc 134 so that the second handle 120 is restrained (locked) at the lock position (PL) and cannot be moved away from the first handle 110.

In operation, when the second handle 120 is pivoted from the first position (P1) to the second position (P2) along the rotational path (R), the machining portion 150 is actuated for machining a cable and a connector. The second position (P2) is defined by means for defining the second position, such as an adjustable cam 160. In the embodiment shown in FIGS. 1C and 2C, the means for defining the second position (P2) is an adjustable cam 160 disposed between the first plate

112*a* and the second plate 112*b* of the end portion 112 of the first handle 110 in an orientation that is generally perpendicular to the first plate 112*a* and the second plate 112*b* for preventing the second handle 120 from moving beyond the adjustable cam 160. During the process in which the second handle 120 is moved from the first position (P1) to the second position (P2), at least one of the periphery of the third plate 122*a* and the fourth plate 122*b* or both will ultimately abut against the adjustable cam 160 and the second handle 120 cannot move further toward the first handle 110 at the second position (P2). Furthermore, the lock position (PL) is between the first position (P1) and the second position (P2) and is close to the second position (P2).

Figure 4A:
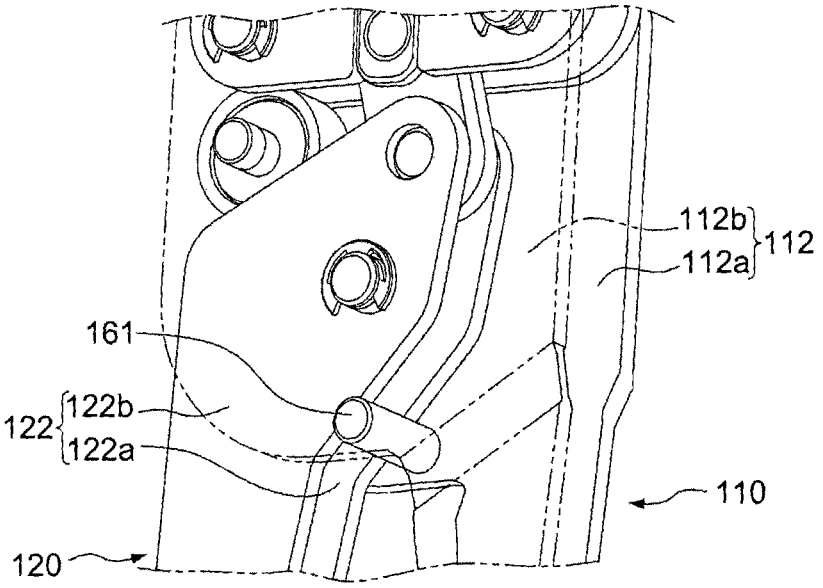
FIG. 4A is a regionally enlarged view of a crimp tool of the embodiment.

As shown in the regionally enlarged view of FIG. 4A, the adjustable cam 160 in this embodiment is a pin 161 disposed between the first plate 112*a* and the second plate 112*b* of the end portion 112 of the first handle 110 in an orientation that is generally perpendicular to the first plate 112*a* and the second plate 112*b*. The pin 161 is at the proximate side of the end portion 122 of the second handle 120 so that the pin 161 is included in an angle formed by the axles defined by the lengthwise directions of the first handle 110 and the second handle 120. In operation, the handles 110 and 120 are grasped and the second handle 120 pivots along the path (R) toward the first handle 110 and ultimately the peripheries of both the third plate 122*a* and the fourth plate 122*b* of the end portion 122 of the second handle 122 abut against the periphery of the pin 161. Thus, the pin 161 defines the second position (P2). In addition, to allow a user to adjust the range of the pivot of the second handle 120 so as to adjust the extent of the movement of a machining block 220 of the machining portion 120 in the first direction (L1), the pin 161 is removable and can be replaced with another pin 161 of a different diameter. By selecting different pins with different diameters, a user can decide the range of the pivot of the second handle 120 and, consequently, the user can decide the extent of the movement of a machining block 220 of the machining portion 120 in the first direction (L1) so as to accomplish precision machining of a connector.

Figure 4B:
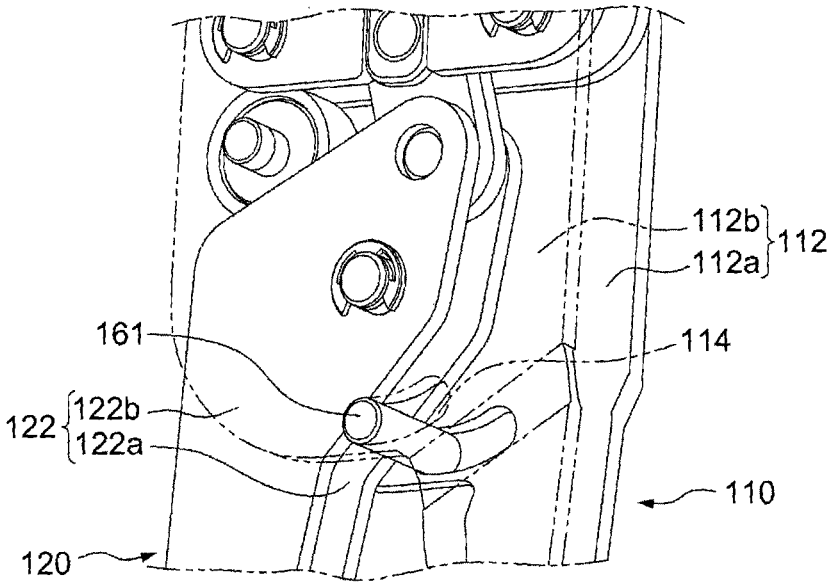
FIG. 4B is a regionally enlarged view of a crimp tool of another embodiment.

In the embodiment shown in FIG. 4B, the means for defining the second position (P2) includes: an arced slot 114 disposed in both the first plate 112*a* and the second plate 112*b* of the first handle 110, and a pin 161 slidably disposed in the arced slot 114. In alternative embodiments, the arced slot 114 is disposed in only one of the first plate 112*a* and the second plate 112*b* of the first handle 110. The arced slot 114 is at the proximate side of the end portion 122 of the second handle 120 so that the arced slot 114 is included in an angle formed by the axles defined by the lengthwise directions of the first handle 110 and the second handle 120. Users can adjust the location of the pin 161 in the arced slot 114 so as to define the second position (P2). Users can thereby control the range of the pivot of the second handle 120 and decide the extent of the movement of a machining block 220 of the machining portion 150 in the first direction (L1) so as to accomplish precision machining of a connector.

Figure 4C:
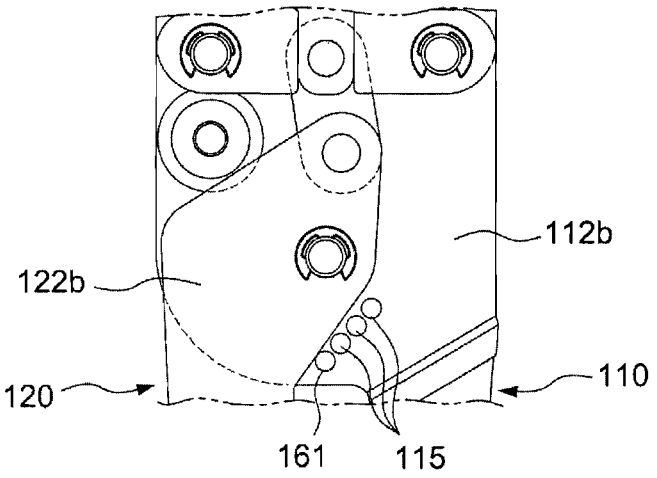
FIG. 4C is a regionally enlarged view of a crimp tool of a further embodiment.

In the embodiment shown in FIG. 4C, the means for defining the second position (P2) includes: a plurality of threaded holes 115 provided in both the first plate 112*a* and the second plate 112*b* of the first handle 112, and a bolt 161 to be selectively threaded into one of the plurality of threaded holes 115. The threaded holes 115 are aligned and are disposed along the proximate periphery of the end portion 122 of the second handle 120. The plurality of threaded holes 115 are included in an angle formed by the axles defined by the lengthwise directions of the first handle 110 and the second handle 120. Users can selectively screw the bolt 161 in one of the threaded holes 115 to define the second position (P2). Users can thereby control the range of the pivot of the second handle 120 and decide the extent of the movement of a machining block 220 of the machining portion 150 in the first direction (L1) so as to accomplish precision machining of a connector. In an alternative embodiment, the plurality of threaded holes 115 are provided in one of the first plate 112*a* and the second plate 112*b* of the first handle 112, the bolt 161 is replaced with a pin 161 without threads and the threaded holes 115 are replaced with holes without threads.

Figure 4D:
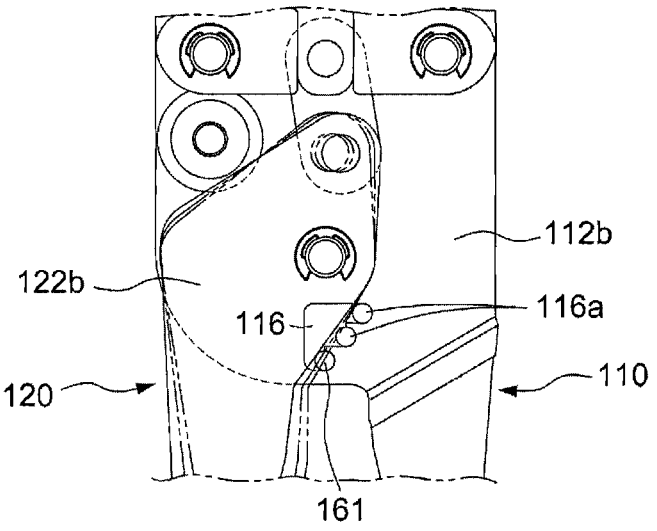
FIG. 4D is a regionally enlarged view of a crimp tool of a still further embodiment.

In the embodiment shown in FIG. 4D, the means for defining the second position (P2) includes: an opening 116 having a plurality of notches 116*a* disposed at an inner periphery thereof and a pin 161 for selective engagement with one of the plurality of notches 116*a*. The opening 116 is formed in both the first plate 112*a* and the second plate 112*b* of the end portion 112 of the first handle 110. The inner periphery is zigzagged and each of the plurality of notches 116*a* is provided at a corner of the zigzagged inner periphery. Each of the plurality of notches 116*a* is configured and sized to engage with the pin 161 inserted therein. The plurality of notches 116*a* is included in an angle formed by the axles defined by the lengthwise directions of the first handle 110 and the second handle 120. Users can selectively insert the pin 161 into one of the notches 161*a* to define the second position (P2). Users can thereby control the range of the pivot of the second handle 120 and decide the extent of the movement of a machining block 220 of the machining portion 150 in the first direction (L1) so as to accomplish precision machining of a connector. In an alternative embodiment, the plurality of notches 116*a* are provided in only one of the first plate 112*a* and the second plate 112*b* of the end portion 112 of the first handle 110.

In the embodiment shown in FIG. 4E1, the means for defining the second position (P2) includes: a pin 161 disposed between the first plate 112*a* and the second plate 112*b* of the end portion 112 of the first handle 110 in an orientation that is generally perpendicular to the first plate 112*a* and the second plate 112*b*, and a sleeve 162 wrapping around the pin 161 whereby the second position (P2) of the second handle 120 can be adjusted by replacing the sleeve 162 with another sleeve 162 having a different thickness. The pin 161 wrapped with the sleeve 162 is included in an angle formed by the axles defined by the lengthwise directions of the first handle 110 and the second handle 120. Users can selectively use sleeves 162 of a different thickness (see FIG. 4E2) for the pin 161 to define the second position (P2). When the second handle 120 is pivoted toward the first handle 110, the second handle 120 will ultimately contact and be stopped by the outer periphery of the sleeve 162 wrapped around the pin 161. The second handle 120 is thus prevented from moving forward toward the first handle 110. Users can thereby control the range of the pivot of the second handle 120 and decide the extent of the movement of a machining block 220 of the machining portion 150 in the first direction (L1) so as to accomplish precision machining of a connector. In an alternative embodiment, the pin 161 wrapped with the sleeve 162 is provided in only one of the first plate 112*a* and the second plate 112*b* of the end portion 112 of the first handle 110.

In the embodiment shown in FIG. 4F1, the means for defining the second position (P2) includes: a pin 161 disposed between the first plate 112*a* and the second plate 112*b* of the end portion 112 of the first handle 110 in an orientation that is generally perpendicular to the first plate 112*a* and the second plate 112*b* and a sleeve 163 surrounding and hooked on the pin 161 with its inner periphery. As shown in FIG. 4F2, the sleeve 163 has a plurality of arced recesses D1, D2, D3, D4 disposed in the inner periphery 164 thereof, and, as such, the sleeve 163 has different thicknesses at locations corresponding to each of the arced recesses. The pin 161 is hooked on one of the plurality of arced recesses D1, D2, D3, D4 and is included in an angle formed by the axles defined by the lengthwise directions of the first handle 110 and the second handle 120. When the second handle 120 is pivoted toward the first handle 110, the second handle 120 will ultimately contact and be stopped by the outer periphery of the sleeve 163 hooked on the pin 161. The second handle 120 is thus prevented from moving forward toward the first handle 110. Through selectively hooking the sleeve 163 on the pin 161 with one of the different arced recesses D1, D2, D3, D4 thereof, the second handle is arranged to contact different portions of the sleeve that have different thicknesses. For example, where the second handle 120 contacts a position of the sleeve that is comparatively thicker, the range of the pivot of the second handle 120 is comparatively smaller and vice versa. Accordingly, users can control the range of the pivot of the second handle 120 and decide the extent of the movement of a machining block 220 of the machining portion 150 in the first direction (L1) so as to accomplish precision machining of a connector.

Figure 4G:
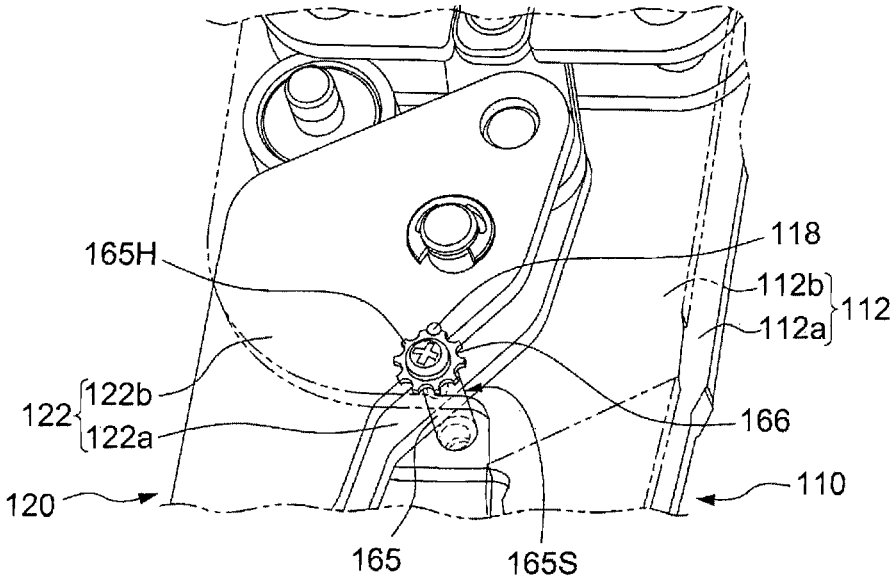
FIG. 4G is a regionally enlarged view of a crimp tool of a still further embodiment.

In the embodiment shown in FIG. 4G, the means for defining the second position (P2) includes: an eccentric shaft 165 rotatably disposed between the first plate 122*a* and the second plate 122*b* of the end portion 122 of the first handle 110 in an orientation that is generally perpendicular to the first plate 122*a* and the second plate 122*b*, and an insert 118. The eccentric shaft 165 has a spline-shaped head 165H having a plurality of notches 166 along its periphery. The insert 118 is for insertion into one of the plurality of notches 166 for preventing rotation of the eccentric shaft 165. In one embodiment of the present invention, the eccentric shaft 165 is threadly engaged with the corresponding holes provided in the first plate 122*a* and the second plate 122*b*. The eccentric shaft 165 has various radii along the circumference thereof. The outer periphery 165S along the circumference of the eccentric shaft 165 is positioned to prevent the second handle 120 from moving further toward the first handle 110 and thus defines the second position (P2) of the second handle 120. In operation, a user rotates the eccentric shaft 165 to a particular orientation so that a particular outer periphery 165S of the eccentric shaft 165 with a particular radius corresponds to the second handle 120 and then puts the insert 118 into the notches 166 of the spline-shaped head 165H to prevent rotation of the eccentric shaft 165. As such, the particular outer periphery 165S of the eccentric shaft 165 will contact the second handle 120 and prevent it from moving further toward the first handle 110. Consequently, the user can control the range of the pivot of the second handle 120 and decide the extent of the movement of a machining block 220 of the machining portion 150 in the first direction (L1) so as to accomplish precision machining of a connector.

Figure 4H:
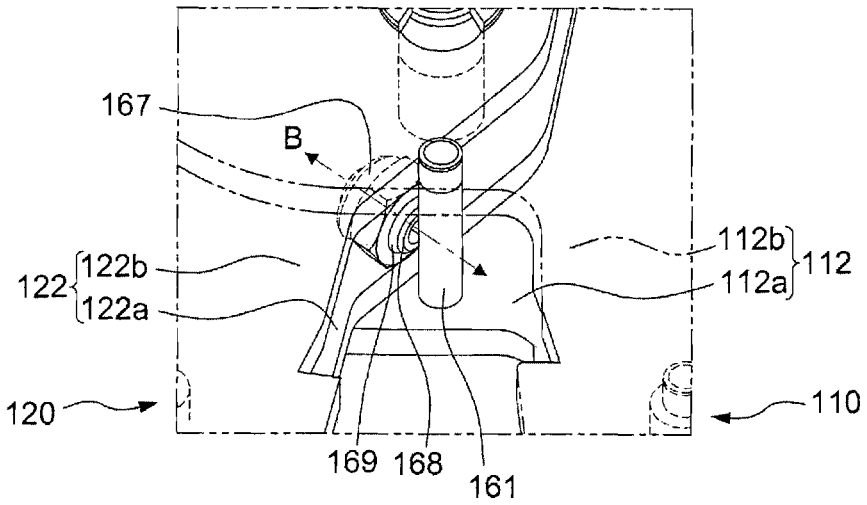
FIG. 4H is a regionally enlarged view of a crimp tool of a still further embodiment.
Figure 5A:
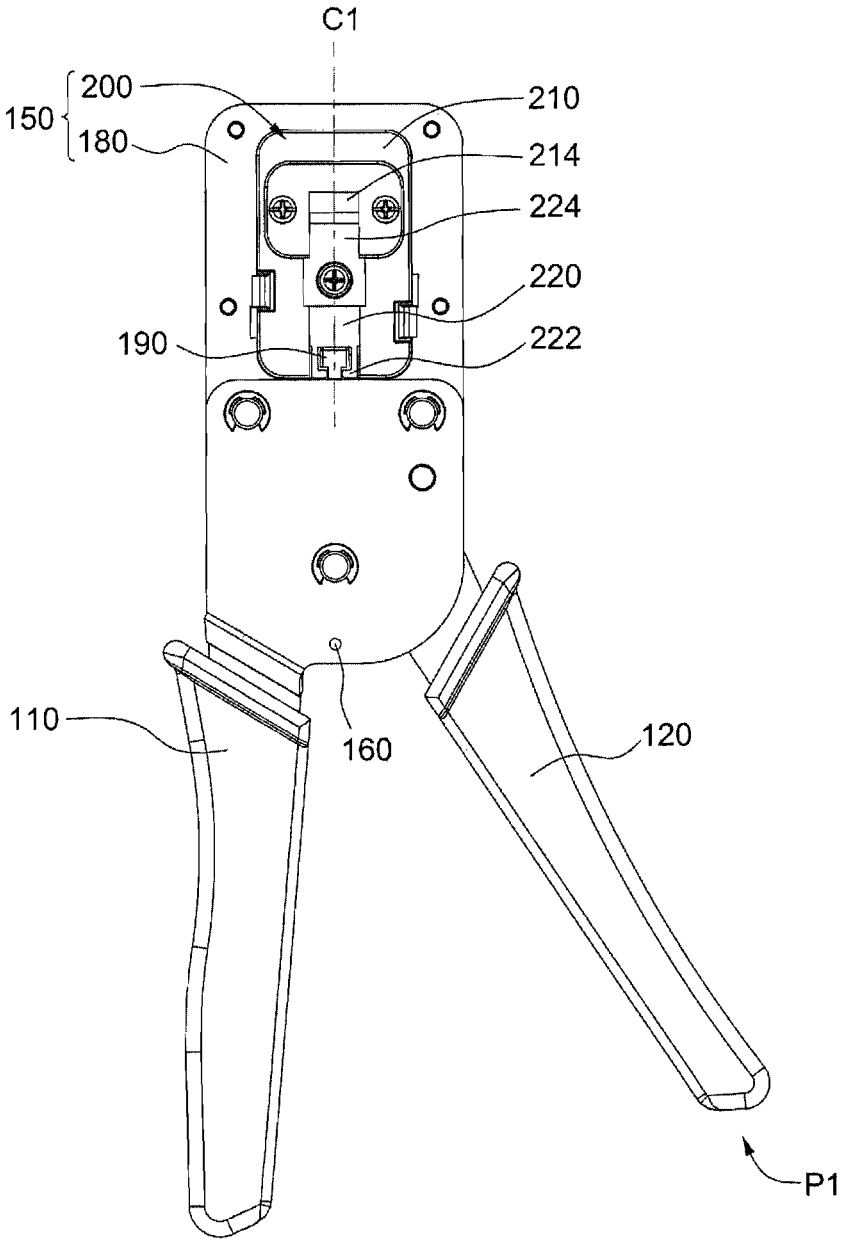
FIG. 5A is a schematic view showing the opposite side of the embodiment shown in FIG. 1A.
Figure 5B:
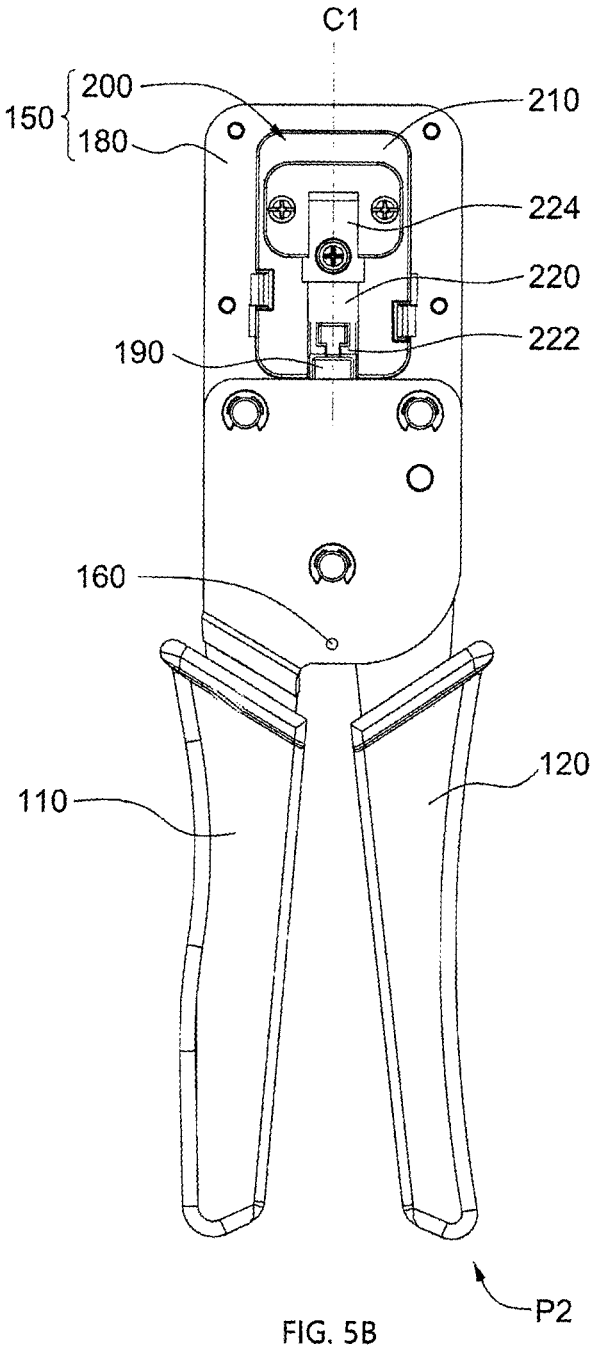
FIG. 5B is a schematic view showing the opposite side of the embodiment shown in FIG. 1C.
Figure 6A:
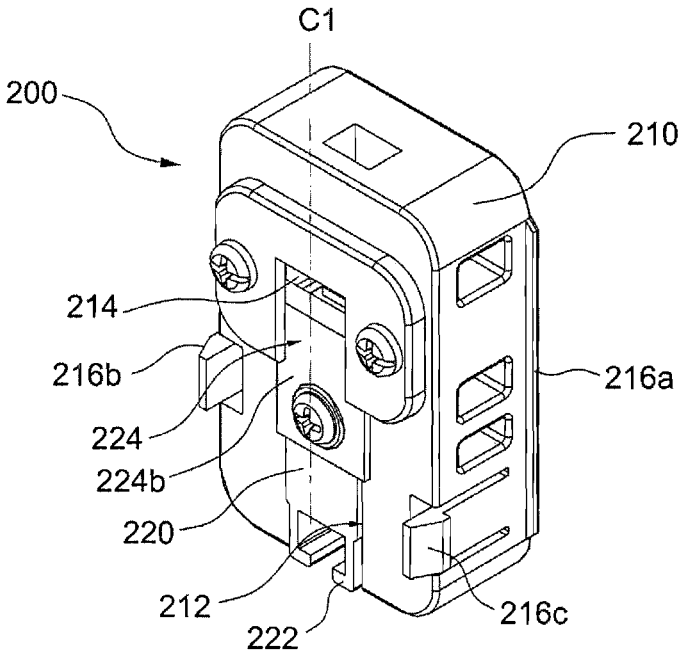
FIG. 6A is a schematic view showing the cassette of one embodiment of the present invention in a resting state wherein a shearing structure is shown.
Figure 6B:
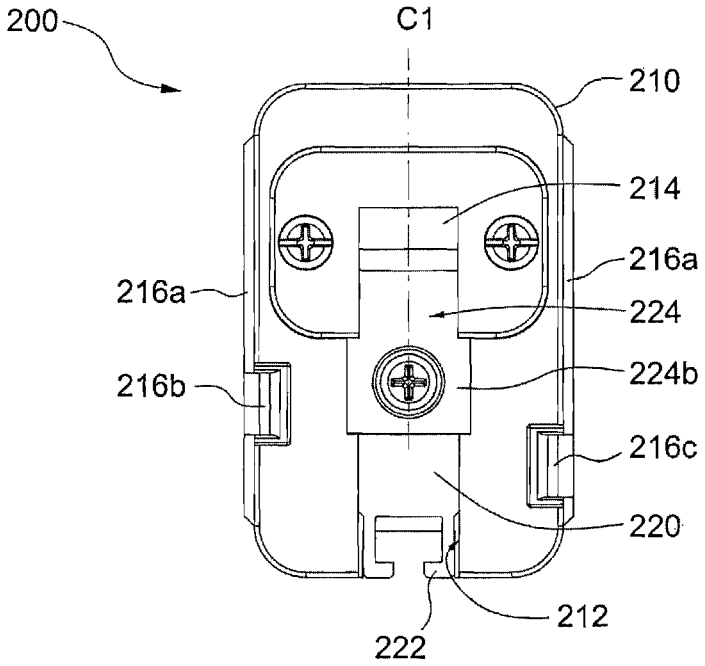
FIG. 6B is another schematic view showing the cassette of the embodiment in the resting state wherein the shearing structure is shown.
Figure 7A:
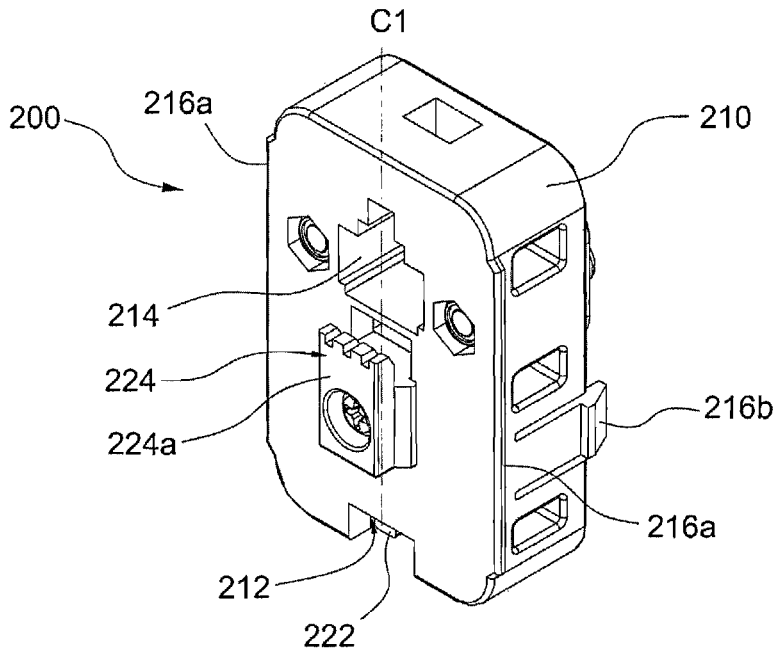
FIG. 7A is a further schematic view showing the cassette of the embodiment in the resting state wherein a crimping structure is shown.
Figure 7B:
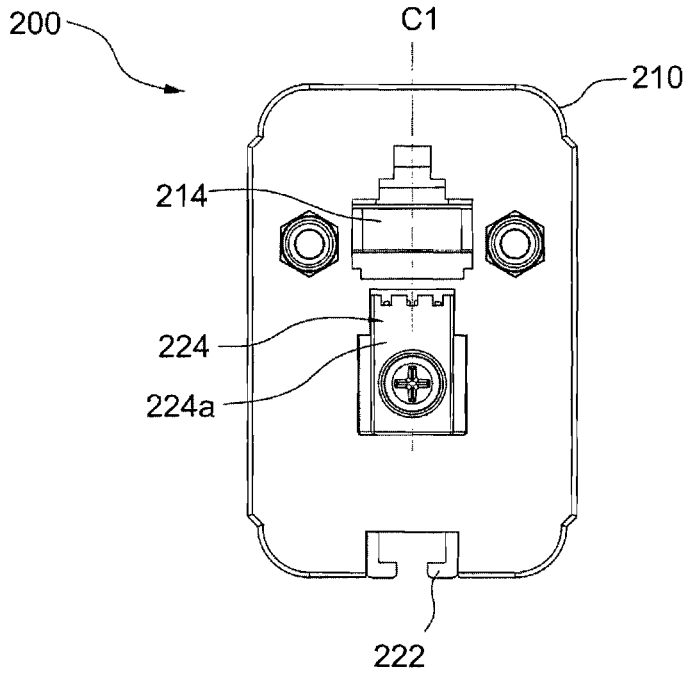
FIG. 7B is still a further schematic view showing the cassette of the embodiment in the resting state wherein the crimping structure is shown.
Figure 8A:
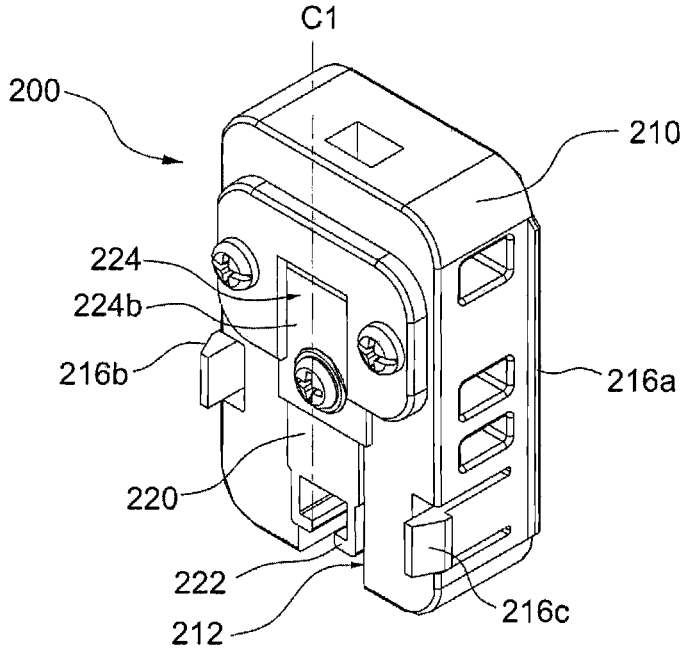
FIG. 8A is a schematic view showing the cassette of the embodiment in a working state wherein a shearing structure is shown.
Figure 8B:
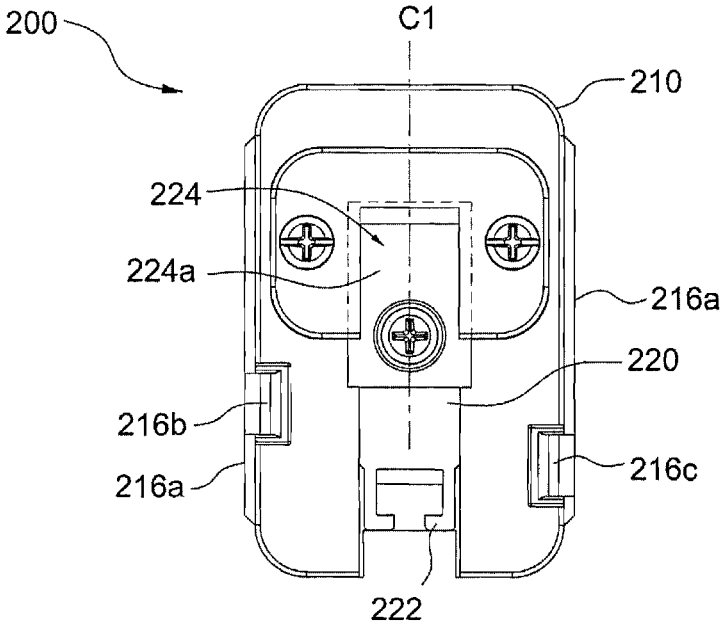
FIG. 8B is another schematic view showing the cassette of the embodiment in the working state wherein the shearing structure is shown.
Figure 9A:
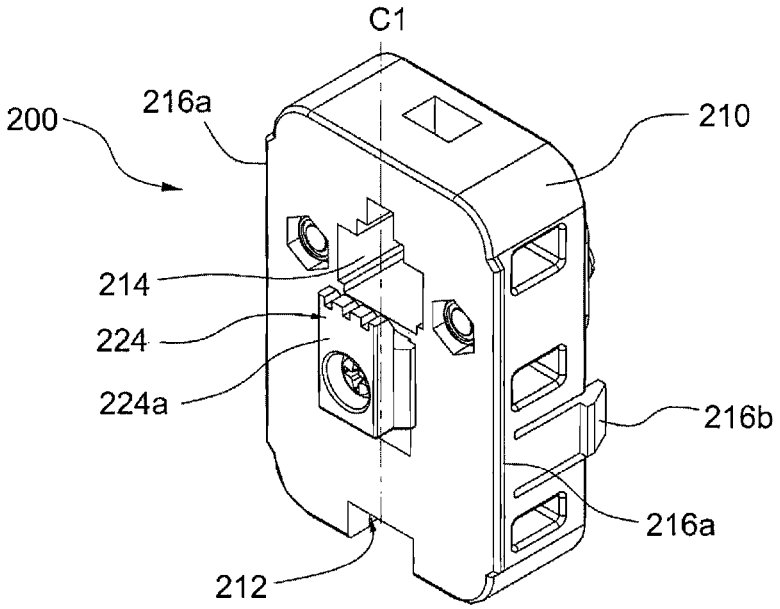
FIG. 9A is a further schematic view showing the cassette of the embodiment in the working state wherein a crimping structure is shown.
Figure 9B:
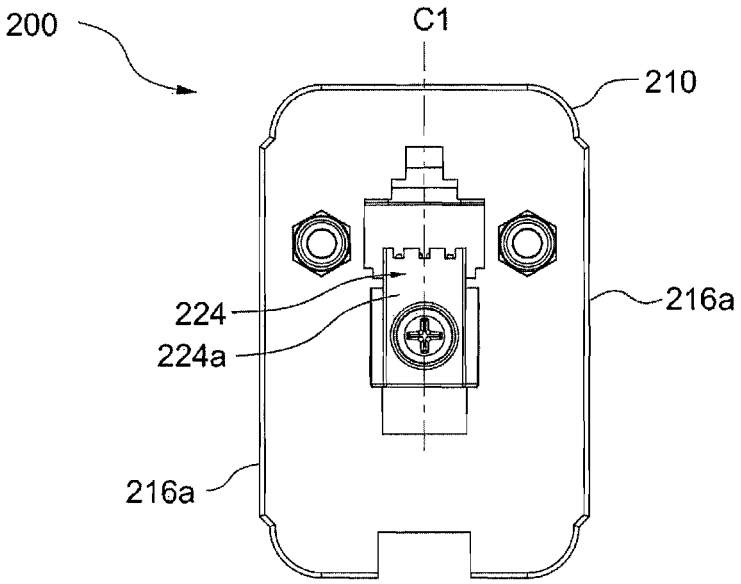
FIG. 9B is still a further schematic view showing the cassette of the embodiment in the working state wherein the crimping structure is shown.

In the embodiment shown in FIG. 4H, the means for defining the second position (P2) includes: a pin 161 disposed between the first plate 112*a* and the second plate 112*b* of the end portion 112 of the first handle 110 in an orientation that is generally perpendicular to the first plate 112*a* and the second plate 112*b*, a holder 167 disposed at the end portion 122 of the second handle 120 and having a through hole 169 therein along a direction (B), and a bolt 168 threadly engaged with the through hole 169 of the holder 167. The holder 167 is preferably disposed between the third plate 122*a* and the fourth plate 122*b* of the end portion 122 of the second handle 120. The direction (B) is perpendicular to the second direction (L2). The pin 161 is included in an angle formed by the axles defined by the lengthwise directions of the first handle 110 and the second handle 120. In operation, the bolt 168 is driven to move forward so that an end thereof is exposed outside of the holder 167. As such, when the second handle 120 is pivoted toward the first handle 110, it will ultimately contact the exposed end of the bolt 168 and is not able to move further toward the first handle 110. A user can adjust the exposed length of the end of the bolt 168 from the holder by properly screwing or unscrewing the bolt 168 in the holder 167. The exposed length of the end of the bolt 168 decides the distance between the holder 167 and the pin 161. Since the holder 167 is installed at the second handle 120 and the pin 161 is installed at the first handle 110, the distance between the holder 167 and the pin 161 decides the range of the pivot of the second handle 120 and decide the extent of the movement of a machining block 220 of the machining portion 150 in the first direction (L1) so as to accomplish precision machining of a connector.

As shown in FIG. 5A to FIGS. 9B, 11A and 11B, the cassette 200 comprises: a cassette body 210 and a machining block 220. The cassette body 210 is detachably disposed in an opening 181 of the frame 180 of the machining portion 150 and has a machining opening 214 therein. The cassette body 210 is provided with a slot 212 therein and the machining block 220 is slidably disposed in the slot 212 along the first axis (C1). With this detachable design, the crimp tool 100 of one embodiment of the present invention can crimp connectors and cables with different specifications by using corresponding cassettes 200. The machining opening 214 of the cassette 200 fits with a particular connector (e.g., RJ-45 connector, RJ-11 connector or the like) and cable. Different cassettes can be used with connectors and cables of different specifications. That is, one embodiment of the present invention provides a frame 180 that can be used with cassettes of different machining openings. The cassette bodies of these cassettes are of the same or similar outer configurations such that all of them can fit with the opening 181 of the same frame 180.

The machining block 220 slidably provided in the slot 212 of the cassette body 210 and the engagement element 222 of the frame 180 are interconnected. The machining block 220 has an engagement element 222 detachable engagement with the driving element 190 of the frame 180. Through the engagement element 222, the driving element 190 drives the machining block 220 to slide along the first axis (C1) to move toward or away from the machining opening 214 (see FIGS. 5A and 5B). When the handles 110, 120 are pressed to move toward each other, the second handle 120 urges the driving element 190 to move upward and the driving element 190 pushes the machining block 220 to slide upward along the first axis (C1) to machine the connector and the cable via the engagement between the driving element 190 and the engagement element 222. In one embodiment of the present invention, the driving element 190 is a male structure, such as a T-shaped protrusion, and the engagement element 222 is a female structure, such as a groove that matches with the T-shaped protrusion. The T-shaped structure prevents the driving element 190 from being easily disengaged from the engagement element 222. As such, the machining block 220 is actuated by the driving element 190 to slide upward or downward in a slot 212 along the first axis (C1).

As illustrated in FIGS. 6A-9B, the machining opening 214 is provided in the cassette body 210 for machining a connector. Corresponding to the machining opening 214, the machining block 220 comprises: at least one machining structure 224. In operation, the engagement element 222 is actuated by the driving element 190 so that the machining block 220 having the engagement element 222 slides along the first axis (C1) in the slot 212 in relation to the machining opening 214. When the machining block 220 is driven to a working position, the at least one machining structure 224 at least partially overlaps with the machining opening 214. As such, the at least one machining structure 224 machines the connector placed in the machining opening 214, such as crimping or shearing a connector having a cable for telephone connections or local area network (LAN).

In one embodiment, the at least one machining structure 224 comprises two machining structures, namely a crimping structure 224*a* disposed at one side of the cassette body 210 and a shearing structure 224*b* disposed at the other side of the cassette body 210. As shown in FIGS. 7A, 7B, 9A, and 9B, the crimping structure 224*a* is a structure for crimping a crystal joint (connector). As shown in FIGS. 6A, 6B, 10A and 10B, the shearing structure 224*b* is a blade for cutting. As illustrated in FIGS. 8A, 8B, 9A and 9B, when the machining block 220 is driven to the working position, the crimping structure 224*a* partially overlaps with one side of the machining opening 214 and the shearing structure 224*b* fully overlaps with the other side of the machining opening 214.

Figure 10A:
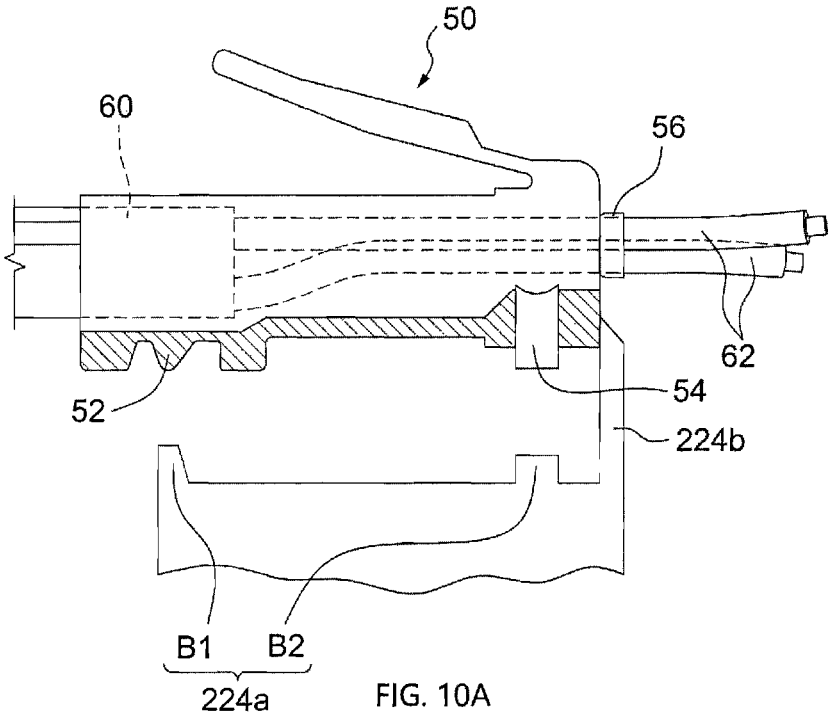
FIG. 10A is a schematic view showing a connector and a cable before being sheared and crimped.
Figure 10B:
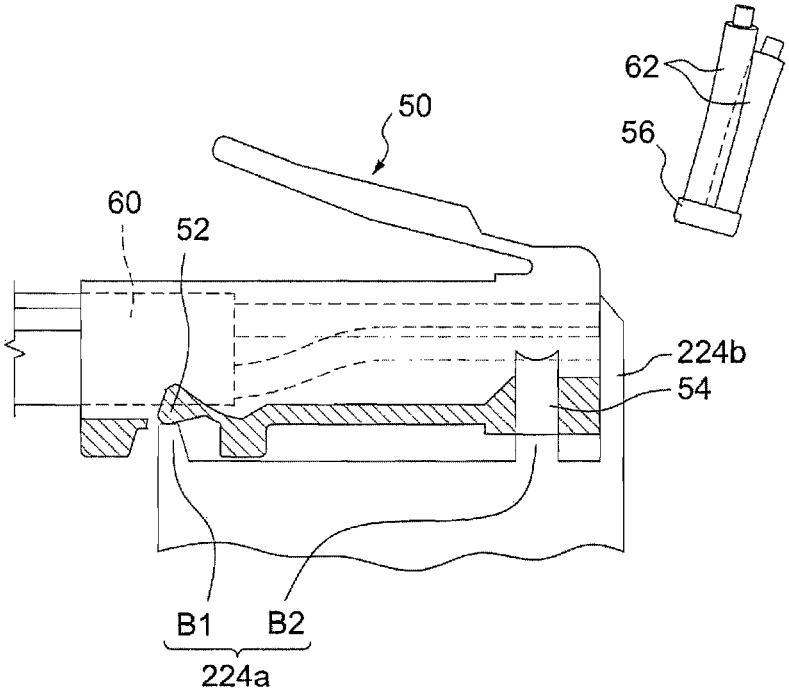
FIG. 10B is a schematic view showing the connector and the cable after being sheared and crimped.

In the embodiment shown in FIGS. 10A and 10B, the crimping structure 224*a* for crimping a crystal connector 50 comprises two crimping blocks B1, B2, which perform the crimping function simultaneously. The first crimping block B1 is for crimping the body of the crystal connector 50 and the second crimping block B2 is provided between the first crimping block B1 and the shearing structure 224*b* for securing the electrical contact blades 54 contained therein to the core(s) 62 of the cable 60. When the machining block 220 is driven by the driving element 190 to the working position, the crimping structure 224*a* partially overlaps with one side of the machining opening 214 and the first crimping block B1 of the crimping structure 224*a* presses against a ridge 52 at the bottom of the crystal connector 50 so that the ridge 52 deforms and breaks. The deformed and broken ridge 52 thus squeezes the outmost insulator(s) of the cable so that the cable 60 is secured to an internal portion of the crystal connector 50. As such, a part of the crystal connector 50 holds the cable 60 and the crystal connector 50 is firmly secured to one end of the cable 60. At the same time, the second crimping structure B2 pushes the electrical contact blades 54 of the crystal connector 50 to move upward and punches through the insulator of the cores 62 of the cable 60 to electrically connect with the cores 62 of the cable 60 so that signals can be transmitted from the cores 62 through the crystal connector 50 to a corresponding female connector.

In one embodiment, the shearing structure 224*b* is a blade for shearing off the redundant parts of the cores 62. When the machining block 220 is driven by the driving element 190 to the working position, the blade 224*b* is moved along the first axis (C1) until it fully overlaps with the side of the machining opening opposite the crimping structure 224*a* and at the same time shears off the ends of the cores 62 that protrude from one end of the crystal connector 50. In a preferred embodiment, the blade 224 can also be arranged to shear off both the protruded parts of the cores 62 and the appendix 56 of crystal connector 50 as shown in FIGS. 10A and 10B. As such, the ends of the sheared cores 62 are flush with the sheared end of the crystal connector 50. In alternative embodiments of the present invention, the location of the shearing structure 224*b* relative to the crystal connector 50 can be arranged in accordance with the needs of a specific user and might be different from that shown in FIGS. 10A and 10B.

Figure 11A:
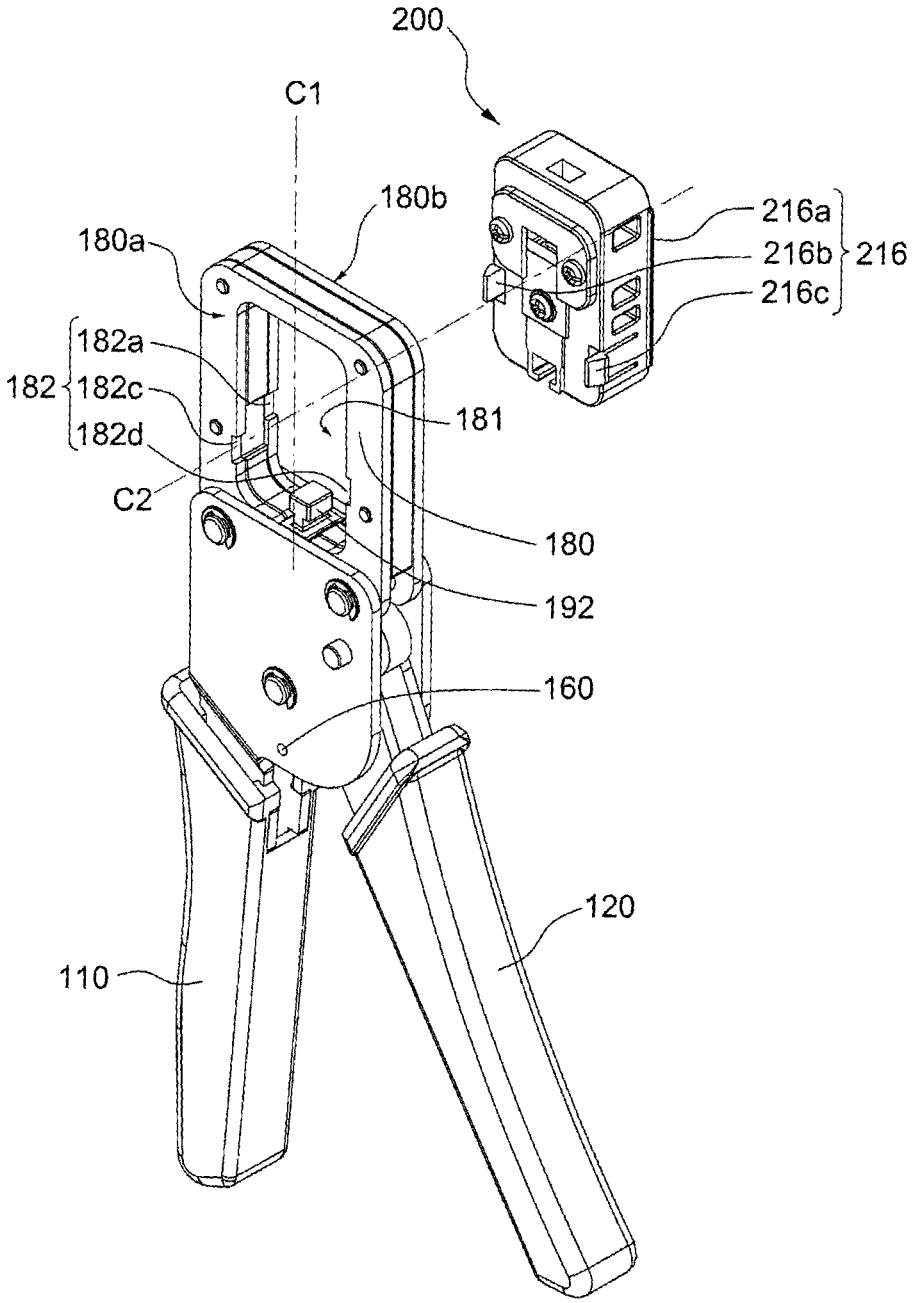
FIG. 11A is a schematic view showing one embodiment of the present invention in which a cassette is to be inserted into an opening of a machining portion of a tool body from one side thereof.
Figure 11B:
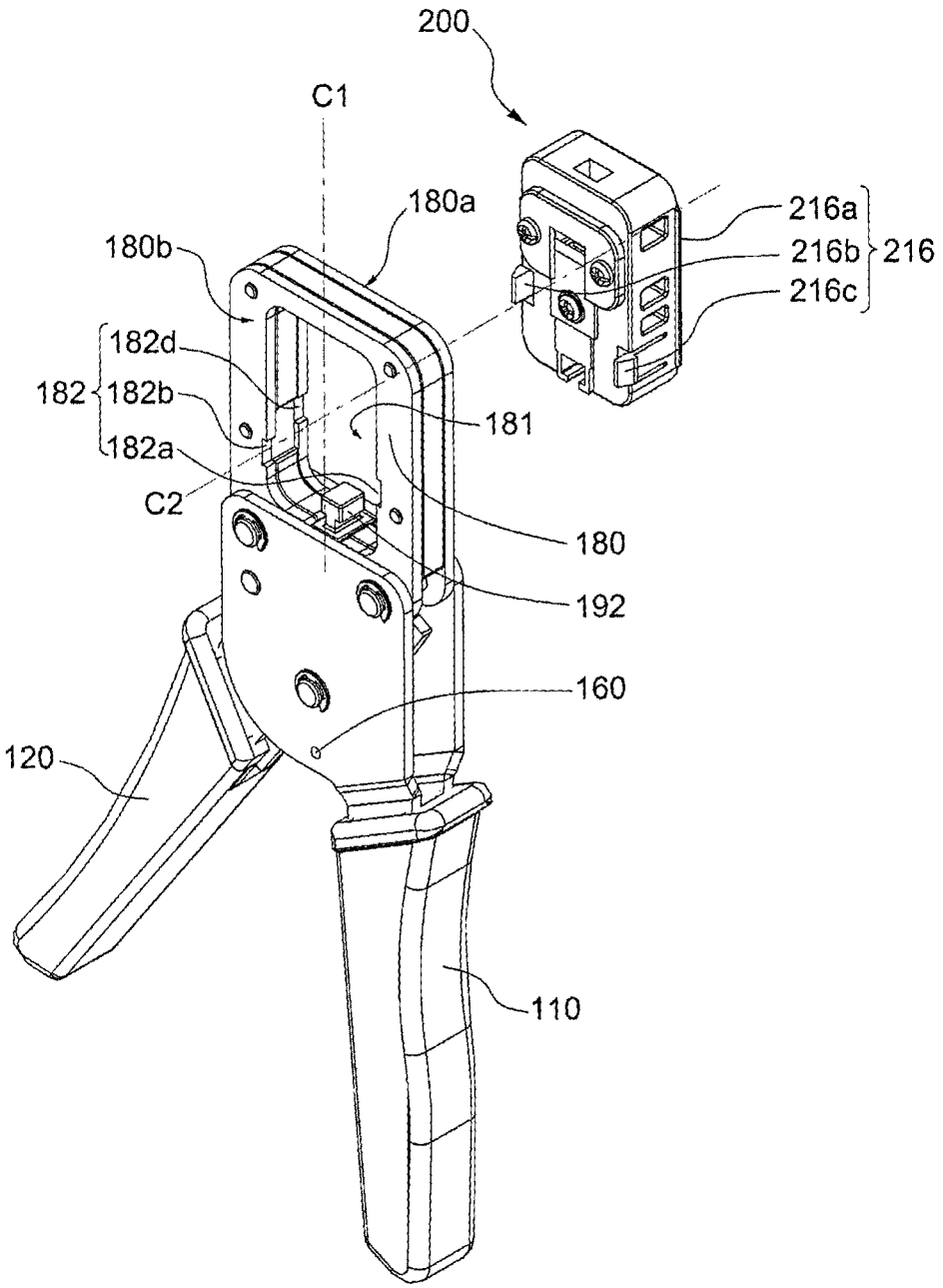
FIG. 11B is a schematic view showing one embodiment of the present invention in which a cassette is to be inserted into an opening of a machining portion of a tool body from the other side thereof.

To ensure that the machining block 220 works steadily and properly when it machines a connector and/or a cable, the cassette 200 should be firmly placed within the opening 181 of the machining portion of the frame 180. As shown in FIGS. 11A and 11B, the machining portion of the frame 180 further comprises: a first connecting structure 182 disposed in the inner lateral surfaces of the opening 181 and the cassette body 210 of the cassette 200 further comprises: a second connecting structure 216 disposed thereon, wherein the first connecting structure 182 engages with the second connecting structure 216 so that the cassette body is secured within the frame 180. The design of the engagements between the first connecting structure 182 and second connecting structure 216 as described below has the benefit of easy assembly of the cassette 200 to the machining portion of the frame 180 and easy disassembly of the cassette 200 from the machining portion of the frame 180, in addition to the benefit of the firm engagement between the cassette 220 and the opening 181 of the machining portion of the frame 180.

The second connecting structure 216 comprises a stopper 216*a* abutting against one of a first surface 180*a* and a second surface 180*b* of the frame 180 of the tool body 210 along a second axis (C2) perpendicular to the first axis (C1) when the cassette body 210 is disposed in the opening 181 of the machining portion of the frame 180. The second connecting structure 216 comprises: a first hook 216*b* and a second hook 216*c* respectively disposed at the two lateral sides of the cassette body 210. The first hook 216*b* and the second hook 216*c* extend away from the stopper 216*a* in a direction substantially parallel to the second axis (C2). When the stopper 216*a* abuts against one of the first surface 180*a* and the second surface 180*b* of the frame 180 of the tool body 210, the first hook 216*b* and the second hook 216*c* engage with the other one of the first and the second surfaces 180*a*, 30*b* of the machining portion of the frame 180 so as to secure the cassette 200 in the machining portion of the frame 180.

Referring to FIGS. 11A and 11B, one embodiment of the present invention provides a crimp tool 100 that is convenient for both right-handed and left-handed users. Specifically, the cassette 200 can be inserted into the opening 181 of the frame 180 from either the first surface 180*a* or the second surface 180*b* of the frame 180. As the second handle 120 is pivotable in relation to the first handle 110 with respect to a pivot provided at the joints of the first handle 110 and the second handle 120, the first handle 110 is defined as a stationary handle and the second handle 120 is defined as the moving handle. When a right-handed user uses the crimp tool 100, the cassette 200 might be inserted into the opening 181 of the frame 180 from the second surface 180*b* of the frame 180 as shown in FIG. 11A. As such, the right-handed user can use his/her left hand to hold a connector with cable and place it into the machining opening 214 of the cassette 200 and use his/her right hand to operate the crimp tool 100. The first handle 110 is placed between and abuts against the thumb and the palm of the right hand so that the first handle 110 is held still. The other four fingers of the right hand are placed upon the second handle 120 for pressing against the second handle 120 to move toward the first handle 110. When the right handle 120 is moved adjacent to (or abutting against) the first handle 110, the machining block 220 is driven by the driving element 190 to the working position and the connector with the cable is machined.

Similarly, when a left-handed user operates the crimp tool 100, the cassette 200 might be inserted into the opening 181 of the machining portion of the frame 180 from the first surface 180*a* of the frame 180 as shown in FIG. 11B. Accordingly, the left-handed user can use his/her right hand to hold a connector with cable and place it into the machining opening 214 of the cassette 200 and uses his/her left hand to operate the crimp tool 100. The first handle 110 is placed between and abuts against the thumb and the palm of the left hand so that the first handle 110 is held still. The other four fingers of the left hand are placed upon the second handle 120 for pressing against the second handle 120 to move it toward the first handle 110 so as to machine the connector.

In one embodiment of the present invention, the first hook 216*b* and the second hook 216*c* are asymmetrically disposed at the two lateral sides of the cassette body 210 along the direction of the first axis (C1). The first connecting structure 182 comprises: a first notch 182*a*, a second notch 182*b*, a third notch 182*c* and a fourth notch 182*d* wherein the first notch 182*a* and the third notch 182*c* are disposed in one lateral inner surface of the opening 181 of the frame 180 and the second notch 182*b* and the fourth notch 182*d* are disposed in the other lateral inner surface of the opening 181 of the frame 180. The first notch 182*a* and the fourth notch 182*d* are at the same first height and the second notch 182*b* and the third notch 182*c* are at the same second height. The first height is higher than the second height. The first notch 182*a* and the second notch 182*b* form a depression from the second surface 180*b* of the frame 180 and the third notch 182*c* and the fourth notch 182*d* form a depression from the first surface 180*a* of the frame 180.

With the above structures, when the cassette 200 is inserted into the opening 181 of the machining portion of the frame 180 from the second surface 180*b* of the frame 180 as shown in FIG. 11A along the second axis (C2), the first hook 216*b* and the second hook 216*c* respectively engage with the first notch 182*a* and the second notch 182*b*. The heads of the first hook 216*b* and the second hook 216*c* will ultimately abut against the first surface 180*a* of the frame 180 and the stopper 216*a* will abut against the second surface 180*b* of the frame 180. Similarly, when the cassette 200 is inserted into the opening 181 of the machining portion of the frame 180 from the first surface 180*a* of the frame 180 as shown in FIG. 11B along the second axis (C2), the first hook 216*b* and the second hook 216*c* respectively engage with the fourth notch 182*d* and the third notch 182*c*. The heads of the first hook 216*b* and the second hook 216*c* will ultimately abut against the second surface 180*b* of the frame 180, and the stopper 216*a* will abut against the first surface 180*a* of the frame 180. Thus, the cassette 200 can be placed into the opening 181 of the frame 180 from either the first surface 180*a* or the second surface 180*b* of the frame 180 depending on the user's habit. Under either of the two assembly manners, the hand tool 100 performs the same crimping and shearing functions well.

In addition to the benefits mentioned above, with both the crimping structure 224*a* and the shearing structure 224*b* provided at the machining block 220, the crimp tool 100 is capable of being used in one step to simultaneously secure the crystal connector 50 to the cable 60, electrically connect the electrical contact blades 54 of the crystal connector 50 to the cores 62 of the cable 60, and shear off the both the protruded parts of the cores 62 and the appendix 56 of the crystal connector 50.

The foregoing embodiments are illustrative of the technical concepts and characteristics of the present invention so as to enable a person skilled in the art to gain insight into the content disclosed herein and to implement the present invention accordingly. However, it is understood that the embodiments are not intended to restrict the scope of the present invention. Hence, all equivalent modifications and variations made to the disclosed embodiments without departing from the spirit and principle of the present invention should fall within the scope of the appended claims.

What is claimed is:

1. A crimp tool comprising:

a first handle, comprising an end portion comprising a first plate and a second plate spaced apart from the first plate;

a second handle, an end portion of the second handle being pivotally connected with the end portion of the first handle and disposed between the first plate and the second plate, wherein the second handle pivots along a rotational path between a first position where the second handle is away from the first handle and a second position where the second handle is adjacent to the first handle;

a means for defining the second position comprising a pin disposeed between the first plate and the second plate and perpendicular to the first plate and the second plate, the means for defining the second position defines the second position of the second handle along the rotational path by abutting against the second handle and preventing the second handle from further rotating toward the first handle so as to define the second position of the second handle; and wherein the means for defining the second position allows adjustment of the second position so as to provide adjustment of a range of the pivot of the second handle toward the first handle along the rotational path.

2. The crimp tool of claim 1, wherein the first plate and the second plate are generally parallel with each other and the means for defining the second position is the pin disposed between the first plate and the second plate in an orientation that is perpendicular to the first plate and the second plate for preventing the second handle from moving beyond the pin.

3. The crimp tool of claim 2, wherein the pin is removable and the crimp tool further comprises a sleeve wrapping around the pin whereby the second position of the second handle can be adjusted by replacing the sleeve with another sleeve having a different thickness.

4. The crimp tool of claim 2, wherein the pin is interchangeable with another pin with a different diameter so as to adjust the second position of the second handle and when the second handle is moved to the second position, the end portion of the second handle does not contact a machining portion of the crimp tool.

5. The crimp tool of claim 1, wherein the means for defining the second position comprises an arced slot disposed in at least one of the first plate or the second plate of the first handle, and the pin slidably disposed in the arced slot.

6. The crimp tool of claim 1, wherein the means for defining the second position comprises a plurality of holes provided in at least one of the first plate or the second plate of the first handle and the pin for selective insertion into one of the plurality of holes.

7. The crimp tool of claim 1, wherein the means for defining the second position comprises an opening having a plurality of notches disposed at an inner periphery thereof and the pin for selective engagement with one of the plurality of notches.

8. The crimp tool of claim 1, wherein the means for defining the second position comprises the pin disposed between the first plate and the second plate in an orientation that is perpendicular to the first plate and the second plate, a holder disposed at the end portion of the second handle and having a through hole therein and a bolt threadly engaged with the through hole of the holder wherein the bolt can be driven until it is exposed from the holder.

9. The crimp tool of claim 1, wherein the means for defining the second position comprises the pin disposed between the first plate and the second plate in an orientation that is perpendicular to the first plate and the second plate and a sleeve surrounding the pin, the sleeve having a plurality of arced recesses disposed at an inner periphery of the sleeve, each of the plurality of arced recesses corresponding to a different thickness along the circumference thereof wherein the pin is engaged with one of the plurality of arced recesses.

10. The crimp tool of claim 1, wherein the pin comprises an eccentric shaft and has a spline-shaped head including a plurality of notches along a periphery of the head, the means for defining the second position further comprising an insert for insertion into one of the plurality of notches for preventing rotation of the eccentric shaft.

11. The crimp tool of claim 1 further comprising a lock mechanism, comprising:

a latch, comprising:

a disc; and a shaft passing through and fixed with the disc, the shaft being coaxial with the disc, wherein the latch is pivotally disposed at the end portion of the first handle along a transverse direction and is switchable between a third position and a fourth position, and a retainer, disposed at the end portion of the first handle for retaining the latch at the third position or the fourth position, wherein when the latch is at the third position, the shaft restrains the second handle at the first position and when the latch is at the fourth position, the disc restrains the second handle at a latching position that is between the first position and the second position.

12. The crimp tool of claim 11, wherein the shaft is integrally formed with the disc and the retainer is not in the path of the second handle between the first position and the second position.

13. The crimp tool of claim 12, wherein the retainer is a seat having a through hole and a recess formed therein, the latch is movably inserted into the recess, and the recess communicates with the through hole, and when the latch is at the third position, the disc is within the recess, and when the latch is at the fourth position, the disc at least partially protrudes from the recess along the transverse direction.

14. The crimp tool of claim 13, wherein the end portion of the second handle comprises a third plate and a fourth plate opposite the third plate, wherein the third plate and the fourth plate of the end portion of the second handle are sandwiched between the first plate and the second plate of the end portion of the first handle, and a part of the seat is sandwiched between the third plate and the fourth plate of the end portion of the second handle, and the length of the seat along the transverse direction is approximately the same as the distance between the third plate and the fourth plate of the end portion of the second handle.

15. The crimp tool of claim 1, further comprising:

a frame, connected with the first handle;

a driving element, connected with and actuated by the second handle, the direction of motion of the driving element defining a first axis; and a cassette, comprising:

a cassette body to be detachably disposed in an opening of the frame of a tool body, the cassette body having a machining opening therein; and a machining block, slidably disposed in the cassette body, the machining block having an engagement element for detachable engagement with the driving element of the tool body;

wherein through the engagement element, the driving element drives the machining block to slide along the first axis to move toward or away from the machining opening.

16. The crimp tool of claim 15, wherein the driving element is a male structure, the engagement element is a female structure, the cassette body is provided with a slot therein and the machining block is slidably disposed in the slot, and wherein the machining block comprises: at least one machining structure, and when the machining block is driven to a working position, the at least one machining structure at least partially overlaps with the machining opening.

17. The crimp tool of claim 16, wherein the at least one machining structure comprises a crimping structure disposed at one side of the cassette body and a shearing structure disposed at the other side of the cassette body and wherein when the machining block is driven to the working position, the crimping structure partially overlaps with one side of the machining opening and the shearing structure fully overlaps with the other side of the machining opening.

18. The crimp tool of claim 17, further comprising: a first connecting structure disposed in inner lateral surfaces of the opening and the cassette body further comprising: a second connecting structure disposed thereon, wherein the first connecting structure engages with the second connecting structure so that the cassette body is secured within the tool body.

19. The crimp tool of claim 18, wherein the second connecting structure comprises a stopper abutting against one of a first and a second surfaces of the frame of the tool body along a second axis perpendicular to the first axis when the cassette body is disposed in the opening of the frame of the tool body.

20. The crimp tool of claim 1, wherein the pin comprises an eccentric shaft rotatably disposed between the first plate and the second plate and in an orientation that is perpendicular to the first plate and the second plate.

21. The crimp tool of claim 1, wherein the means for defining the second position includes the pin having an eccentric rotatable shaft having an eccentric outer surface, which can abut against the second handle for preventing the second handle from further rotating toward the first handle so as to define the second position of the second handle, and through the rotation of the eccentric shaft, different locations of the eccentric outer surface abut against the second handle so as to adjust the second position of the second handle.

* * * * *